US010594026B2

(12) United States Patent
Choi et al.

(10) Patent No.: US 10,594,026 B2
(45) Date of Patent: Mar. 17, 2020

(54) ANTENNA DEVICE AND ELECTRONIC DEVICE INCLUDING THE SAME

(71) Applicant: Samsung Electronics Co., Ltd., Gyeonggi-do (KR)

(72) Inventors: Sanghoon Choi, Gyeonggi-do (KR); Taeyoung Kim, Gyeonggi-do (KR); Sungyeul Hong, Gyeonggi-do (KR); Jinwoo Jung, Seoul (KR); Nak-Chung Choi, Seoul (KR)

(73) Assignee: Samsung Electronics Co., Ltd. (KR)

( * ) Notice: Subject to any disclaimer, the term of this patent is extended or adjusted under 35 U.S.C. 154(b) by 459 days.

(21) Appl. No.: 15/344,028

(22) Filed: Nov. 4, 2016

(65) Prior Publication Data

US 2017/0133752 A1 May 11, 2017

(30) Foreign Application Priority Data

Nov. 6, 2015 (KR) ..... 10-2015-0155836

(51) Int. Cl.
*H01Q 1/27* (2006.01)
*H01Q 1/24* (2006.01)
(Continued)

(52) U.S. Cl.
CPC ..... *H01Q 1/273* (2013.01); *H01Q 1/241* (2013.01); *H01Q 1/48* (2013.01); *H01Q 5/50* (2015.01);
(Continued)

(58) Field of Classification Search
CPC ..... H01Q 1/273; H01Q 21/28; H01Q 9/30; H01Q 7/00; H01Q 5/50; H01Q 1/241; H01Q 1/48
See application file for complete search history.

(56) References Cited

U.S. PATENT DOCUMENTS 7,215,600 B1 5/2007 DeRosa
7,271,774 B2 9/2007 Puuri
(Continued)

FOREIGN PATENT DOCUMENTS

CN 102904986 1/2013
CN 103606736 2/2014
(Continued)

OTHER PUBLICATIONS

International Search Report dated Jan. 6, 2017 issued in counterpart application No. PCT/KR2016/010554, 8 pages.
(Continued)

*Primary Examiner* — Hai V Tran
*Assistant Examiner* — Michael M Bouizza
(74) *Attorney, Agent, or Firm* — The Farrell Law Firm, P.C.

(57) ABSTRACT

An electronic device is provided. The electronic device includes a display; a housing including a side surface that surrounds at least a part of the display; a first conductive member configured to form a first portion of the side surface and to extend along the side surface, wherein the first conductive member includes a first end portion and a second end portion; a first non-conductive member configured to form a second portion of the side surface and to contact the first end portion or the second end portion of the first conductive member; at least one communication circuit electrically connected to a first point of the first conductive member; at least one ground member disposed inside the housing and electrically connected to a second point of the first conductive member, wherein the at least one ground member is spaced apart from the first point of the first conductive member; and a coupling member connected to a part of the housing and configured to be attachable to, and detachable from, a part of a user's body.

18 Claims, 37 Drawing Sheets

(51) Int. Cl.

| | |
|---|---|
| ***H01Q 1/48*** | (2006.01) |
| ***H01Q 5/50*** | (2015.01) |
| ***H01Q 21/28*** | (2006.01) |
| ***H01Q 7/00*** | (2006.01) |
| ***H01Q 9/30*** | (2006.01) |

(52) U.S. Cl.
CPC ..... *H01Q 7/00* (2013.01); *H01Q 9/30* (2013.01); *H01Q 21/28* (2013.01)

(56) References Cited

U.S. PATENT DOCUMENTS

| | | | | |
|---|---|---|---|---|
| 7,612,725 | B2 | 11/2009 | Hill et al. | |
| 8,275,327 | B2 | 9/2012 | Yi et al. | |
| 8,833,665 | B2 | 9/2014 | Grange et al. | |
| 2003/0117900 | A1 | 6/2003 | Fujisawa et al. | |
| 2012/0112970 | A1* | 5/2012 | Caballero ..... | H01Q 1/243 343/702 |
| 2012/0229347 | A1 | 9/2012 | Jin et al. | |
| 2013/0027892 | A1 | 1/2013 | Lim et al. | |
| 2014/0354494 | A1 | 12/2014 | Katz | |
| 2015/0091764 | A1 | 4/2015 | Hsieh et al. | |
| 2015/0188217 | A1 | 7/2015 | Tsai et al. | |
| 2016/0344096 | A1* | 11/2016 | Erentok ..... | H01Q 1/273 |

FOREIGN PATENT DOCUMENTS

| | | |
|---|---|---|
| CN | 203536554 | 4/2014 |
| JP | 2000-059241 | 2/2000 |

OTHER PUBLICATIONS

European Search Report dated Feb. 9, 2018 issued in counterpart application No. 16862287.6-1205, 10 pages.
Chinese Office Action dated Apr. 25, 2019 issued in counterpart application No. 201680039135.6, 16 pages.
European Search Report dated Aug. 22, 2019 issued in counterpart application No. 16862287.6-1205, 6 pages.
Indian Examination Report dated Oct. 15, 2019 issued in counterpart application No. 201737037685, 7 pages.
Chinese Office Action dated Dec. 26, 2019 issued in counterpart application No. 201680039135.6, 17 pages.

* cited by examiner

ANTENNA DEVICE AND ELECTRONIC DEVICE INCLUDING THE SAME

PRIORITY

This application claims priority under 35 U.S.C. § 119(a) to a Korean Patent Application filed on Nov. 6, 2015 in the Korean Intellectual Property Office and assigned Serial No. 10-2015-0155836, the entire content of which is incorporated herein by reference.

BACKGROUND

1. Field of the Disclosure

The present disclosure relates generally to an electronic device, and more particularly, to an electronic device that includes an antenna device.

2. Description of the Related Art

Electronic devices, including mobile terminals such as "smart phones" and wearable electronic devices to be worn by people, have been made lighter, slimmer, shorter, and smaller, and at the same time, have more functions to meet consumers' purchasing needs.

As the functional differences between electronic devices of respective manufacturers have recently been greatly reduced, the manufacturers have been making an effort to increase the rigidity of the electronic devices, which are being gradually slimmed in order to satisfy consumers' purchasing needs, and to strengthen the design features of the electronic devices. Reflecting this trend, elements (e.g., housings) of electronic devices have been made of metal in order to increase rigidity and achieve a high quality and appealing external appearance of the electronic devices.

Antenna radiation performance may be significantly degraded if a metal case is used in a situation where the thickness of an electronic device becomes smaller in terms of design and a mounting space for an antenna radiator is insufficient. For example, if metal components and internal and external mechanical parts exist around the antenna radiator, the performance of the antenna radiator may be significantly deteriorated by various phenomena caused by the metal, such as a scattering effect, an electromagnetic field trapping effect, mismatching, etc. It is not difficult to manufacture most electronic devices with an antenna radiator since a mounting space for the antenna radiator and a separation distance between the antenna radiator and metal components are sufficient and the exterior of the product is mainly made of a dielectric material, such as plastics. However, since currently used portable electronic devices are made smaller and slimmer in order to appeal to consumers and more frequently uses metal exterior parts, the separation distances between an antenna radiator and metal components and mechanical parts gradually decrease so that it is difficult to obtain sufficient performance using existing antenna technology.

In a case where various electronic devices utilize antennas for wireless Internet, mobile payment, a global roaming service, and the like must be mounted in a wearable electronic device, the device may become thicker, and it may be difficult to make the device compact.

Although attempts have been made to ensure a sufficient separation distance from metal parts in order to prevent the problem, mechanical parts may be excessively deformed, the cost may increase due to additional materials, or the thickness of an electronic device may increase.

SUMMARY

An aspect of the present disclosure may provide an electronic device. The electronic device includes a display; a housing including a side surface that surrounds at least a part of the display; a first conductive member configured to form a first portion of the side surface and to extend along the side surface, wherein the first conductive member includes a first end portion and a second end portion; a first non-conductive member configured to form a second portion of the side surface and to contact the first end portion or the second end portion of the first conductive member; at least one communication circuit electrically connected to a first point of the first conductive member; at least one ground member disposed inside the housing and electrically connected to a second point of the first conductive member, wherein the at least one ground is spaced apart from the first point of the first conductive member; and a coupling member connected to a part of the housing and configured to be attached to, and detached from, a part of a user's body.

BRIEF DESCRIPTION OF THE DRAWINGS

The above and other aspects, features, and advantages of the present disclosure will be more apparent from the following detailed description, taken in conjunction with the accompanying drawings, in which.

DETAILED DESCRIPTION OF EMBODIMENTS OF THE PRESENT DISCLOSURE

Figure 1:
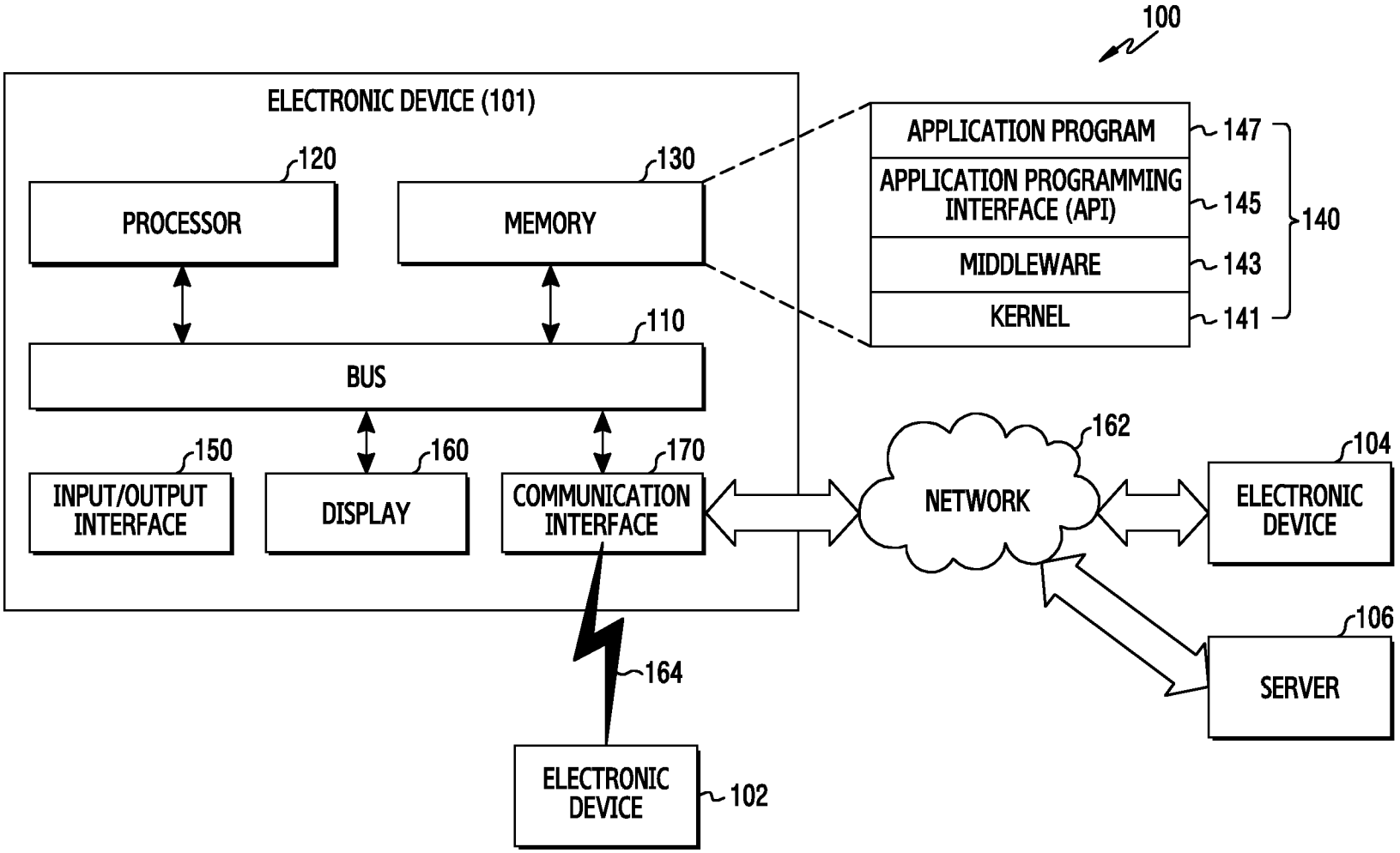
FIG. 1 is a block diagram of a network environment that includes an electronic device according to an embodiment of the present disclosure.

FIGS. 1 through 13C, described below, and the various embodiments used to describe the present disclosure are by way of illustration only and are not intended to be construed in any way to limit the scope of the present disclosure. Those skilled in the art will understand that the principles of the present disclosure may be implemented in any suitably arranged electronic device. The following description with reference to the accompanying drawings is provided to assist in a comprehensive understanding of the scope of the present disclosure as defined by the claims and their equivalents. The following description includes certain details to assist in that understanding but these are intended to be regarded merely as examples. Accordingly, those of ordinary skill in the art will recognize that various changes and modifications of the various embodiments of the present disclosure described herein may be made without departing from the scope and spirit of the present disclosure. In addition, descriptions of well-known functions and constructions may be omitted for clarity and conciseness.

The terms used in the present disclosure are not limited to their dictionary meanings, and are merely used to enable a clear and consistent understanding of the present disclosure. Accordingly, it should be apparent to those skilled in the art that the following description of various embodiments of the present disclosure is provided for illustrative purposes only and not for the purpose of limiting the present disclosure as defined by the appended claims and their equivalents.

It is to be understood that the singular forms "a," "an," and "the" include plural references unless the context clearly dictates otherwise. Thus, for example, reference to "a component surface" includes reference to one or more of such surfaces.

The term "substantially" indicates that the recited characteristic, parameter, or value need not be achieved exactly, but that deviations or variations, including for example, tolerances, measurement error, measurement accuracy limitations and other factors known to those of skill in the art may occur in amounts that do not preclude the effect the characteristic was intended to provide.

The terms "include" and "may include" used herein are intended to indicate the presence of a corresponding function, operation, or element disclosed herein, and are not intended to limit the presence of one or more functions, operations, or elements. In addition, the terms "include" and "have" are intended to indicate that characteristics, numbers, operations, elements disclosed in the present disclosure, or combinations thereof exist. However, additional possibilities of one or more other characteristics, numbers, operations, elements, or combinations thereof may exist.

As used herein, the expression "or" includes any and all combinations of words enumerated together. For example, "A or B" may include either A or B, or may include both A and B.

Although expressions used in various embodiments of the present disclosure, such as "1$^{st}$," "2$^{nd}$," "first," and "second" may be used to express various elements of the various embodiments of the present disclosure, these expressions are not intended to limit the corresponding elements. For example, the above expressions are not intended to limit an order or an importance of the corresponding elements. The above expressions may be used to distinguish one element from another element. For example, a first user device and a second user device are both user devices, and indicate different user devices. For example, a first element may be referred to as a second element, and similarly, the second element may be referred to as the first element without departing from the scope of the present disclosure.

When an element is described as being "connected" to or "accessing" another element, this may indicate that it is directly connected to or accessing the other element, or there may be intervening elements present between the two elements. In contrast, when an element is mentioned as being "directly connected" to or "directly accessing" another element, it is to be understood that there are no intervening elements present.

The term "module" as used herein may imply a unit including one of hardware, software, and firmware, or a combination thereof. The term "module" may be interchangeably used with terms, such as unit, logic, logical block, component, circuit, and the like. A module as described herein may be a minimum unit of an integrally constituted component or may be a part thereof. A module may be a minimum unit for performing one or more functions or may be a part thereof. A module may be mechanically or electrically implemented. For example, a module as described herein includes at least one of an application-specific integrated circuit (ASIC), a field-programmable gate array (FPGA), and a programmable-logic device, which are known, or will be developed, and which perform certain operations.

Unless otherwise defined, all terms used herein have the same meanings as commonly understood by those of ordinary skill in the art to which various embodiments of the present disclosure belong. It will be further understood that terms, such as those defined in commonly used dictionaries, should be interpreted as having meanings that are consistent with their meaning in the context of the relevant art and the various embodiments of the present disclosure, and should not be interpreted in an idealized or overly formal sense unless expressly so defined herein.

An electronic device as used herein may be a device including, but not limited to, an antenna capable of performing a communication function in at least one frequency band. For example, the electronic device may be a smart phone, a tablet personal computer (PC), a mobile phone, a video phone, an electronic book (e-book) reader, a desktop PC, a laptop PC, a netbook computer, a personal digital assistant (PDA), a portable multimedia player (PMP), a moving picture experts group phase 1 or phase 2 (MPEG-1 or MPEG-2) audio layer 3 (MP3) player, a mobile medical device, a camera, and a wearable device (e.g., a head-mounted-device (HMD), such as electronic glasses, electronic clothes, an electronic bracelet, an electronic necklace, an electronic appcessory, an electronic tattoo, a smart watch, and the like).

An electronic device may be a smart home appliance having an antenna. For example, a smart home appliance may include at least one of a television (TV), a digital versatile disc (DVD) player, an audio player, a refrigerator, an air conditioner, a cleaner, an oven, a microwave oven, a washing machine, an air purifier, a set-top box, a TV box (e.g., Samsung HomeSync®, Apple TV®, or Google TV™), a game console, an electronic dictionary, an electronic key, a camcorder, and an electronic picture frame.

An electronic device including an antenna may be one of various medical devices (e.g., a magnetic resonance angiography (MRA) device, a magnetic resonance imaging (MRI) device, a computed tomography (CT) device, imaging equipment, an ultrasonic instrument, and the like), a navigation device, a global positioning system (GPS) receiver, an event data recorder (EDR), a flight data recorder (FDR), a car infotainment device, electronic equipment for a ship (e.g., a vessel navigation device, a gyro compass, and the like), avionics, a security device, a car head unit, an industrial or domestic robot, an automated teller machine (ATM), a point of sales (POS) device, an Internet of Things (IoT) device, and the like.

An electronic device may be part of at least one of an item of furniture or a building/structure including an antenna. An electronic device may be an electronic board, an electronic signature input device, a projector, or any of various measurement machines (e.g., water meter, electric meter, gas meter, a propagation measurement machine, and the like).

An electronic device may be one or more combinations of the aforementioned various devices. In addition, an electronic device may be a flexible device. Moreover, an electronic device is not limited to the aforementioned devices.

Hereinafter, an electronic device according to various embodiments is described with reference to the accompanying drawings. The term "user" may refer to a person who uses an electronic device or a device which uses an electronic device (e.g., an electronic device for performing artificial intelligence (AI)).

FIG. 1 is a block diagram of a network environment 100 including an electronic device 101, according to an embodiment of the present disclosure.

Referring to FIG. 1, the electronic device 101 includes a bus 110, a processor 120, a memory 130, an input/output interface 150, a display 160, and a communication interface 170. In an embodiment of the present disclosure, the electronic device 101 may omit at least one of the components or further include another component.

The bus 110 includes a circuit for connecting the components (e.g., the processor 120, the memory 130, the input/output interface 150, the display 160, and the communication interface 170) and delivering communications (e.g., a control message) therebetween.

The processor 120 includes one or more of a central processing unit (CPU), an application processor (AP), and a communication processor (CP). The processor 120 executes an operation or processes data under control of and/or in communication with another component of the electronic device 101.

The processor 120, which is connected to a long term evolution (LTE) network, determines whether a call is connected over a circuit switched (CS) service network using caller identification information (e.g., a caller phone number) of the CS service network (e.g., a second generation/third generation (2G/3G) network). For example, the processor 120 receives incoming call information (e.g., a CS notification message or a paging request message) of the CS service network over the LTE network (e.g., CS fallback (CSFB)). For example, the processor 120 being connected to an LTE network receives incoming call information (e.g., a paging request message) over the CS service network (e.g., single radio LTE (SRLTE)).

When receiving incoming call information (e.g., a CS notification message or a paging request message) of the CS service network over the LTE network, the processor 120 obtains caller identification information from the incoming call information. The processor 120 displays the caller identification information on the display 160. The processor 120 determines whether to connect the call based on input information corresponding to the caller identification information displayed on the display 160. For example, when detecting input information corresponding to an incoming call rejection, through the input/output interface 150, the processor 120 restricts the voice call connection and maintains the LTE network connection. For example, when detecting input information corresponding to an incoming call acceptance, through the input/output interface 150, the processor 120 connects the voice call by connecting to a CS service network.

When receiving incoming call information (e.g., a CS notification message or a paging request message) of the CS service network over the LTE network, the processor 120 obtains caller identification information from the incoming call information. The processor 120 determines whether to connect the call by comparing the caller identification information with a reception control list. For example, when the caller identification information is included in a first reception control list (e.g., a blacklist), the processor 120 restricts the voice call connection and maintains the connection to the LTE network. For example, when caller identification information is not included in the first reception control list (e.g., the blacklist), the processor 120 connects the voice call by connecting to a CS service network. For example, when the caller identification information is included in a second reception control list (e.g., a white list), the processor 120 connects the voice call by connecting to the CS service network.

When receiving incoming call information (e.g., a paging request message) of a CS service network over an LTE network, the processor 120 sends an incoming call response message (e.g., a paging response message) to the CS service network. The processor 120 suspends the LTE service and receives the caller identification information (e.g., a circuit-switched call (CC) setup message) from the CS service network. The processor 120 determines whether to connect the call by comparing the caller identification information with the reception control list. For example, if caller identification information is included in a first reception control list (e.g., a blacklist), the processor 120 restricts the voice call connection and resumes the LTE network connection. For example, if caller identification information is not included in a first reception control list (e.g., a blacklist), the processor 120 connects the voice call by connecting to a CS service network. For example, if caller identification information is included in a second reception control list (e.g., a white list), the processor 120 connects the voice call by connecting to a CS service network.

The memory 130 may include volatile and/or nonvolatile memory. The memory 130 stores commands or data (e.g., the reception control list) relating to at least another component of the electronic device 101. The memory 130 may store software and/or a program 140. The program 140 may include, for example, a kernel 141, middleware 143, an application programming interface (API) 145, and/or an application program (or "application") 147. At least some of the kernel 141, the middleware 143, and the API 145 may be referred to as an operating system (OS).

The kernel 141 controls or manages system resources (e.g., the bus 110, the processor 120, or the memory 130)

used for performing an operation or function implemented by the other programs (e.g., the middleware 143, the API 145, or the application 147). Furthermore, the kernel 141 provides an interface through which the middleware 143, the API 145, or the application 147 connects the individual elements of the electronic device 101 to control or manage the system resources.

The middleware 143 functions as an intermediary for allowing the API 145 or the application 147 to communicate with the kernel 141 to exchange data.

In addition, the middleware 143 processes one or more task requests received from the application 147 according to priorities thereof. For example, the middleware 143 assigns priorities for using the system resources (e.g., the bus 110, the processor 120, the memory 130, etc.) of the electronic device 101, to at least one of the application 147. For example, the middleware 143 may perform scheduling or load balancing on one or more task requests by processing one or more task requests according to the priorities assigned thereto.

The API 145 is an interface through which the application 147 controls functions provided from the kernel 141 or the middleware 143, and may include at least one interface or function (e.g., an instruction) for file control, window control, image processing, text control, etc.

The input/output interface 150 functions as an interface that transfers instructions or data input from a user or another external device to the other element(s) of the electronic device 101. Furthermore, the input/output interface 150 outputs instructions or data received from the other element(s) of the electronic device 101 to a user or an external electronic device.

The display 160 may include a liquid crystal display (LCD), a light emitting diode (LED) display, an organic LED (OLED) display, a micro electro mechanical system (MEMS) display, an electronic paper display, etc. The display 160 displays various types of content (e.g., a text, images, videos, icons, symbols, etc.) for a user. The display 160 may include a touch screen and receive, for example, a touch, a gesture, a proximity touch, a hovering input, etc., using an electronic pen or a part of a user's body. The display 160 may display a web page.

The communication interface 170 may establish a communication between the electronic device 101 and an external electronic device (e.g., a first external electronic device 102, a second external electronic device 104, or a server 106). For example, the communication interface 170 may communicate with the first external electronic device 102, the second external electronic device 104, or the server 106 in connection to the network 162 through wireless communication or wired communication. For example, a wireless communication may conform to a cellular communication protocol including at least one of LTE, LTE-Advanced (LTE-A), code division multiple access (CDMA), wideband CDMA (WCDMA), universal mobile telecommunication system (UMTS), wireless broadband (WiBro), and global system for mobile communications (GSM).

A wired communication may include at least one of a universal serial bus (USB), a high definition multimedia interface (HDMI), a recommended standard 232 (RS-232), and plain old telephone service (POTS).

The network 162 may include at least one of a telecommunications networks, for example, a computer network (e.g., local area network (LAN) or a wide area network (WAN)), the Internet, and a telephone network.

The electronic device 101 provides an LTE service in a single radio environment by use of at least one module functionally or physically separated from the processor 120. Various embodiments of the present disclosure are described below with reference to a display that includes a bent or curved area and is applied to a housing of an electronic device, in which a non-metal member and a metal member (e.g., a metal bezel) are formed through dual injection molding, but are not limited thereto. For example, the display may be applied to a housing, in which a metal member or a non-metal member is formed of a single material.

Each of the first and second external electronic devices 102 and 104 may be a type of device that is the same as or different from the electronic device 101. According to an embodiment of the present disclosure, the server 106 may include a group of one or more servers. All or some of the operations to be executed by the electronic device 101 may be executed by another electronic device or a plurality of other electronic devices (e.g., the electronic devices 102 and 104 or the server 106). According to an embodiment of the present disclosure, in the case where the electronic device 101 may perform a certain function or service automatically or by request, the electronic device 101 may request some functions that are associated therewith from the electronic devices 102 and 104 or the server 106 instead of or in addition to executing the function or service by itself. The electronic devices 102 and 104 or the server 106 may execute the requested functions or additional functions, and may transmit the results to the electronic device 101. The electronic device 101 may provide the requested functions or services by processing the received results. For this purpose, for example, a cloud computing technique, a distributed computing technique, or a client-server computing technique may be used.

In the description of the present disclosure, a metal member used as an antenna radiator is exemplified by a metal bezel that is disposed along the outer periphery of an electronic device, but is not limited thereto. For example, various metal structures provided in an electronic device may also be used as an antenna radiator. According to an embodiment of the present disclosure, electronic devices applied to illustrative embodiments of the present disclosure may be circular watch type electronic devices, but are not limited thereto. For example, the electronic devices may be various forms of watch type electronic devices or wearable electronic devices.

Figure 2:
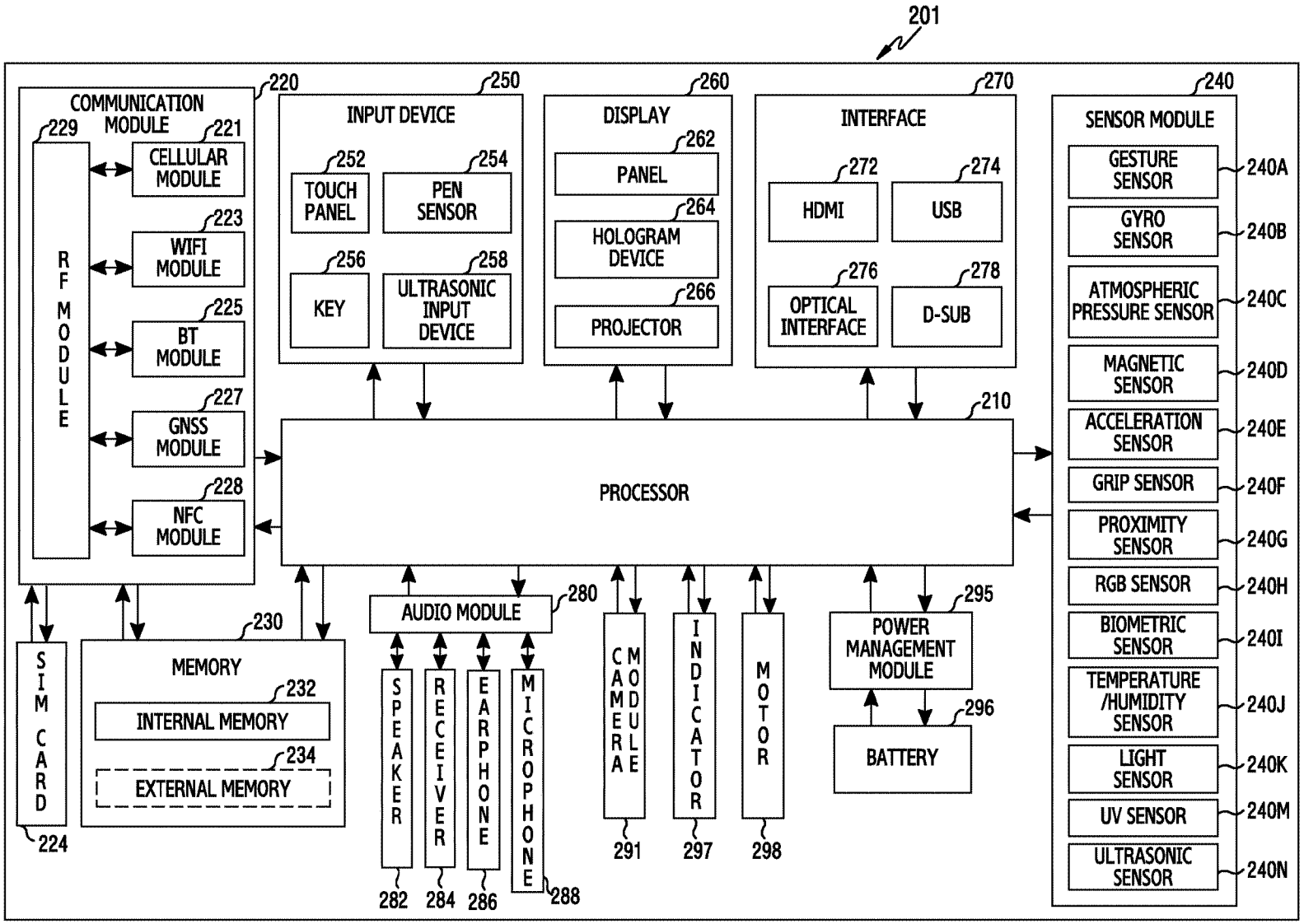
FIG. 2 is a block diagram of an electronic device according to an embodiment of the present disclosure.

FIG. 2 is a block diagram of an electronic device 201, according to an embodiment of the present disclosure.

Referring to FIG. 2, the electronic device 201 may include all or some of the components described with reference to the electronic device 101 of FIG. 1. The electronic device 201 includes at least one processor (e.g. an AP) 210, a communication module 220, a subscriber identification module (SIM) card 224, a memory 230, a sensor module 240, an input device 250, a display 260, an interface 270, an audio module 280, a camera module 291, a power management module 295, a battery 296, an indicator 297, and a motor 298.

The processor 210 controls a plurality of hardware or software elements connected to the processor 210 by driving an OS or an application program. The processor 210 processes a variety of data, including multimedia data, and performs arithmetic operations. The processor 210 may be implemented, for example, with a system on chip (SoC). The processor 210 may further include a graphics processing unit (GPU).

The communication module 220 performs data transmission/reception in communication between the external electronic device 104 or the server 106 which may be connected with the electronic device 201 through the network 162. The communication module 220 includes a cellular module 221, a wireless fidelity (WiFi) module 223, a Bluetooth (BT) module 225, a global navigation satellite system (GNSS) or GPS module 227, a near field communication (NFC) module 228, and a radio frequency (RF) module 229.

The cellular module 221 provides a voice call, a video call, a text service, an Internet service, and the like, through a communication network (e.g., LTE, LTE-A, CDMA, WCDMA, UMTS, WiBro, and GSM, and the like). In addition, the cellular module 221 identifies and authenticates the electronic device 201 within the communication network by using the SIM card 224. The cellular module 221 may perform at least some of the functions that may be provided by the processor 210. For example, the cellular module 221 may perform at least some multimedia control functions.

The cellular module 221 includes a CP. Further, the cellular module 221 may be implemented, for example, with an SoC. Although elements, such as the cellular module 221 (e.g., the CP), the memory 230, and the power management module 295 are illustrated as separate elements with respect to the processor 210 in FIG. 2, the processor 210 may also be implemented such that at least one part (e.g., the cellular module 221) of the aforementioned elements is included in the processor 210.

The processor 210 or the cellular module 221 loads an instruction or data, which is received from each non-volatile memory connected thereto or at least one of different elements, to a volatile memory and processes the instruction or data. In addition, the processor 210 or the cellular module 221 stores data, which is received from at least one of different elements or generated by at least one of different elements, into the non-volatile memory.

Each of the WiFi module 223, the BT module 225, the GNSS module 227, and the NFC module 228 includes a processor for processing data transmitted/received through a corresponding module. Although the cellular module 221, the WiFi module 223, the BT module 225, the GNSS module 227, and the NFC module 228 are illustrated in FIG. 2 as separate blocks, at least some (e.g., two or more) of the cellular module 221, the WiFi module 223, the BT module 225, the GNSS module 227, and the NFC module 228 may be included in one integrated circuit (IC) or IC package. For example, at least some of processors corresponding to the cellular module 221, the WiFi module 223, the BT module 225, the GNSS module 227, and the NFC module 228 (e.g., a communication processor corresponding to the cellular module 221 and a WiFi processor corresponding to the WiFi module 223) may be implemented with an SoC.

The RF module 229 transmits/receives data, for example an RF signal. The RF module 229 may include, for example, a transceiver, a power amplifier module (PAM), a frequency filter, a low noise amplifier (LNA), and the like. In addition, the RF module 229 may further include a component for transmitting/receiving a radio wave in free space in a wireless communication, for example, a conductor, a conducting wire, and the like. Although it is illustrated in FIG. 2 that the cellular module 221, the WiFi module 223, the BT module 225, the GNSS module 227, and the NFC module 228 share one RF module 229, at least one of the cellular module 221, the WiFi module 223, the BT module 225, the GNSS module 227, the NFC module 228 may transmit/receive an RF signal via a separate RF module.

The SIM card 224 may be inserted into a slot formed at a certain location of the electronic device 201. The SIM card 224 includes unique identification information (e.g., an integrated circuit card identifier (ICCID)) or subscriber information (e.g., an international mobile subscriber identity (IMSI)).

The memory 230 includes an internal memory 232 or an external memory 234.

The internal memory 232 may include, for example, at least one of a volatile memory (e.g., a dynamic random access memory (DRAM), a static RAM (SRAM), a synchronous dynamic RAM (SDRAM), and the like) or a non-volatile memory (e.g., a one time programmable read only memory (OTPROM), a programmable ROM (PROM), an erasable and programmable ROM (EPROM), an electrically erasable and programmable ROM (EEPROM), a mask ROM, a flash ROM, a NOT-AND (NAND) flash memory, a NOT-OR (NOR) flash memory, and the like). The internal memory 232 may be a solid state drive (SSD).

The external memory 234 may include a flash drive, and may further include, for example, a compact flash (CF) drive, a secure digital (SD) drive, a micro-SD drive, a mini-SD drive, an extreme digital (xD) drive, a memory stick, and the like. The external memory 234 may be operatively coupled to the electronic device 201 via various interfaces.

The electronic device 201 may further include a storage unit (or a storage medium), such as a hard drive.

The sensor module 240 measures a physical quantity or detects an operation state of the electronic device 201, and converts the measured or detected information into an electrical signal. The sensor module 240 includes, for example, at least one of a gesture sensor 240A, a gyro sensor 240B, a atmospheric pressure sensor or air sensor 240C, a magnetic sensor 240D, an acceleration sensor 240E, a grip sensor 240F, a proximity sensor 240G, a color sensor 240H (e.g., a red, green, blue (RGB) sensor), a biometric sensor 240I, a temperature/humidity sensor 240J, a light sensor 240K, an ultraviolet (UV) light sensor 240M, and ultrasonic sensor 240N.

The ultrasonic sensor 240N may include at least one ultrasonic transducer. The ultrasonic sensor 240N may include a contact type ultrasonic transducer (for example, an enclosed type ultrasonic transducer) and a non-contact type ultrasonic transducer (for example, a resonant type ultrasonic transducer), each of which are described in greater detail below. The contact type ultrasonic transducer and the non-contact type ultrasonic transducer may be controlled to be exclusively or simultaneously operated under a control of the processors 120, 220.

Additionally or alternatively, the sensor module 240 may include, for example, an E-node sensor, an electromyography (EMG) sensor, an electroencephalogram (EEG) sensor, an electrocardiogram (ECG) sensor, a fingerprint sensor, and the like.

The sensor module 240 may further include a control circuit for controlling at least one or more sensors included therein.

The input device 250 includes a touch panel 252, a (digital) pen sensor 254, a key 256, or an ultrasonic input unit 258.

The touch panel 252 recognizes a touch input, for example, by using at least one of an electrostatic type configuration, a pressure-sensitive type configuration, and an ultrasonic type configuration. The touch panel 252 may further include a control circuit. In the instance where the touch panel 252 is of an electrostatic type, not only is physical contact recognition possible, but proximity recognition is also possible. The touch penal 252 may further include a tactile layer, which provides the user with a tactile reaction.

The (digital) pen sensor 254 may include, for example, a recognition sheet which is a part of the touch panel 252 or is separated from the touch panel 252. The key 256 may include, for example, a physical button, an optical key, or a keypad. The ultrasonic input device 258 may detect ultrasonic waves generated by an input tool through the microphone 288, and may confirm data corresponding to the detected ultrasonic waves.

The (digital) pen sensor 254 may be implemented, for example, by using the same or similar method of receiving a touch input of a user or by using an additional sheet for recognition.

The key 256 may be, for example, a physical button, an optical key, a keypad, or a touch key.

The ultrasonic input unit 258 is a device by which the electronic device 201 detects a reflected sound wave through a microphone 288 and is capable of radio recognition. For example, an ultrasonic signal, which may be generated by using a pen, may be reflected off an object and detected by the microphone 288.

The electronic device 201 may use the communication module 220 to receive a user input from an external device (e.g., a computer or a server) connected thereto.

The display 260 includes a panel 262, a hologram 264, or a projector 266.

The panel 262 may be, for example, a liquid-crystal display (LCD), an active-matrix organic light-emitting diode (AM-OLED), and the like. The panel 262 may be implemented, for example, in a flexible, transparent, or wearable manner. The panel 262 may be constructed as one module with the touch panel 252.

The hologram device 264 uses the interference of light and displays a stereoscopic image in the air.

The projector 266 displays an image by projecting a light beam onto a screen. The screen may be located internally or externally to the electronic device 201.

The display 260 may further include a control circuit for controlling the panel 262, the hologram device 264, or the projector 266.

The interface 270 includes, for example, an HDMI 272, a USB 274, an optical communication interface 276, or a D-subminiature (D-sub) connector 278. The interface 270 may be included, for example, in the communication interface 160 of FIG. 1. Additionally or alternatively, the interface 270 may include, for example, a mobile high-definition link (MHL), an SD/multi-media card (MMC) or a standard of the Infrared Data association (IrDA).

The audio module 280 bilaterally converts a sound and an electrical signal. At least some elements of the audio module 280 may be included in the input/output interface 150 of FIG. 1. The audio module 280 converts sound information which is input or output through a speaker 282, a receiver 284, an earphone 286, the microphone 288, and the like.

The speaker 282 may output a signal of an audible frequency band and a signal of an ultrasonic frequency band. Reflected waves of an ultrasonic signal emitted from the speaker 282 may be received, or a signal of an external audible frequency band may also be received.

The camera module 291 is a device for image and video capturing, and may include one or more image sensors (e.g., a front sensor or a rear sensor), a lens, an image signal processor (ISP), or a flash (e.g., an LED or a xenon lamp). In certain instances, it may prove advantageous to include two or more camera modules.

The power management module 295 manages power of the electronic device 201. The power management module 295 may include a power management integrated circuit (PMIC), a charger IC, or a battery gauge.

The PMIC may be placed inside an IC or SoC semiconductor. Charging is classified into wired charging and wireless charging. The charger IC charges a battery, and prevents an over-voltage or over-current flow from a charger. The charger IC includes a charger IC for at least one of the wired charging and the wireless charging.

The wireless charging may be classified, for example, into a magnetic resonance type, a magnetic induction type, and an electromagnetic type. An additional circuit for the wireless charging, for example, a coil loop, a resonant circuit, a rectifier, and the like, may be added.

The battery gauge measures, for example, a residual quantity of the battery 296 and a voltage, current, and temperature during charging. The battery 296 stores or generates electricity and supplies power to the electronic device 201 by using the stored or generated electricity. The battery 296 may include a rechargeable battery or a solar battery.

The indicator 297 indicates a certain state, for example, a booting state, a message state, a charging state, and the like, of the electronic device 201 or a part thereof (e.g., the processor 210).

The motor 298 converts an electrical signal into a mechanical vibration.

The electronic device 201 includes a processing unit (e.g., a GPU) for supporting mobile TV. The processing unit for supporting mobile TV processes media data according to a protocol of, for example, digital multimedia broadcasting (DMB), digital video broadcasting (DVB), media flow, and the like.

Each of the aforementioned elements of the electronic device 201 may consist of one or more components, and names thereof may vary depending on a type of the electronic device 201. The electronic device 201 may include at least one of the aforementioned elements. Some of the elements may be omitted, or additional other elements may be further included. In addition, some of the elements of the electronic device 201 may be combined and constructed as one entity, so as to equally perform functions of corresponding elements before combination.

Figure 3A:
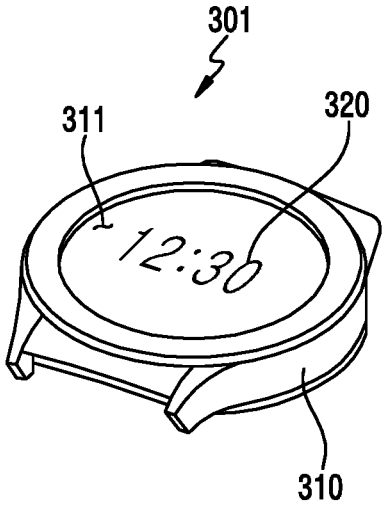
FIGS. 3A and 3B are perspective views of an electronic device according to an embodiment of the present disclosure.
Figure 3B:
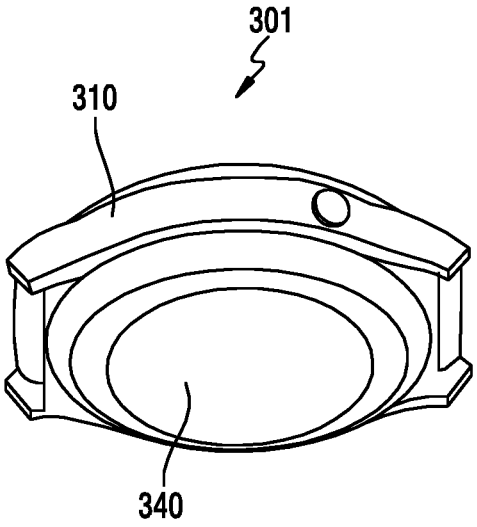

At least some parts of a device (e.g., modules or functions thereof) or method (e.g., operations) may be implemented with an instruction stored in a non-transitory computer-readable storage media for example. The instruction may be executed by the processor 210, to perform a function corresponding to the instruction. The non-transitory computer-readable storage media may be, for example, the memory 230. At least some parts of the programming module may be implemented (e.g., executed), for example, by the processor 210. At least some parts of the programming module may include modules, programs, routines, a set of instructions, processes, and the like, for performing one or more functions. FIGS. 3A and 3B are perspective views of an electronic device 301 according to an embodiment of the present disclosure.

Referring to FIGS. 3A and 3B, the electronic device 301 is illustrated as a watch type wearable electronic device, but is not limited thereto. Furthermore, a display is illustrated as having a circular shape, but is not limited thereto.

The electronic device 301 may include a housing 310, the display 320, and a back cover 340.

A through-hole 311 with a certain size may be disposed in the center of a first surface (hereinafter, the front surface) of the housing 310 to form an opening. The extent to which the display 320 is exposed may be determined by the size of the through-hole 311. The housing 310 may include a peripheral portion that forms the through-hole and a side wall that is perpendicular, or inclined, to the peripheral portion and surrounds the through-hole. The housing 310 may protect various elements (e.g., the display, a battery, a board, etc.) that are disposed therein. The through-hole 311 is illustrated as having a circular shape in FIG. 3A, but is not limited thereto.

According to an embodiment of the present disclosure, the housing 310 may be coupled with the back cover 340. A button, a crown, or the like may be additionally mounted on one side of the housing 310, and a coupling member configured to be attached to, and detached from, a part of a user's body may be further included. The crown may be a manipulation part for selecting or manipulating a function of the electronic device 301.

According to an embodiment of the present disclosure, the housing 310 may be implemented with a metal material. The housing 310 may be used as an antenna radiator for transmitting and receiving data with an external device. For example, the housing may be used as an antenna of a 2G, 3G, and/or 4G cellular module. Alternatively, the housing may also be used as an antenna of a module for short-range communication (e.g., NFC communication, Bluetooth communication, magnetic secure transmission (MST) communication, etc.).

According to an embodiment of the present disclosure, the housing 310 may have a feeding point or a ground point on the inner wall thereof, and may be electrically connected with a board (e.g., printed circuit board (PCB)), etc. Illustrative information about a method in which the housing 310 operates as an antenna radiator may be provided through FIGS. 5 to 12 described below.

According to an embodiment of the present disclosure, the display 320 may be at least partially exposed externally through the through-hole of the housing 310. The exposed display 320 may have a shape (e.g., a circular shape, a rectangular shape, etc.) that corresponds to the shape of the through-hole. The display 320 may include the area that is exposed through the through-hole and the area that is positioned inside the housing 310. A separate cover may be attached to the area that is exposed through the through-hole. The separate cover may include glass. The display 320 may include a display panel (e.g., LCD, OLED, etc.) that displays images, texts, or the like, or may include a panel (e.g., a touch panel) that receives a user input. The display 320 may be implemented with a one cell touch screen panel (TSP) AM-OLED (OCTA) in which a touch panel and an AM-OLED panel are integrally coupled with each other.

According to an embodiment of the present disclosure, the back cover 340 may be coupled with the housing 310 to fix and protect internal elements. The back cover 340 may be formed of a non-metallic or non-conductive material. The back cover 340 may prevent the housing 310 from making contact with a user's skin.

According to various embodiments, the electronic device 301 may further include a coupling member that is connected to the housing 310 to secure the electronic device 301 to a user's wrist. The coupling member may be implemented in the shape of two straps that are connected to opposite edges of the housing 310, respectively.

Figure 4A:
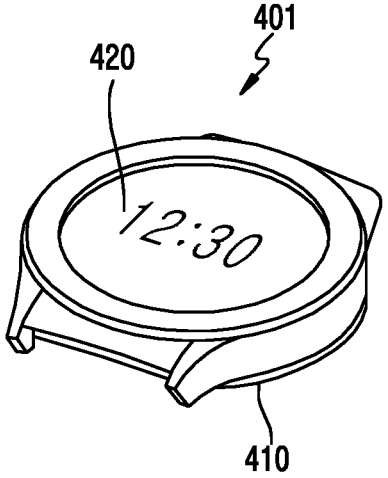
FIGS. 4A and 4B are a perspective view and an exploded view, respectively, of an electronic device according to an embodiment of the present disclosure.
Figure 4B:
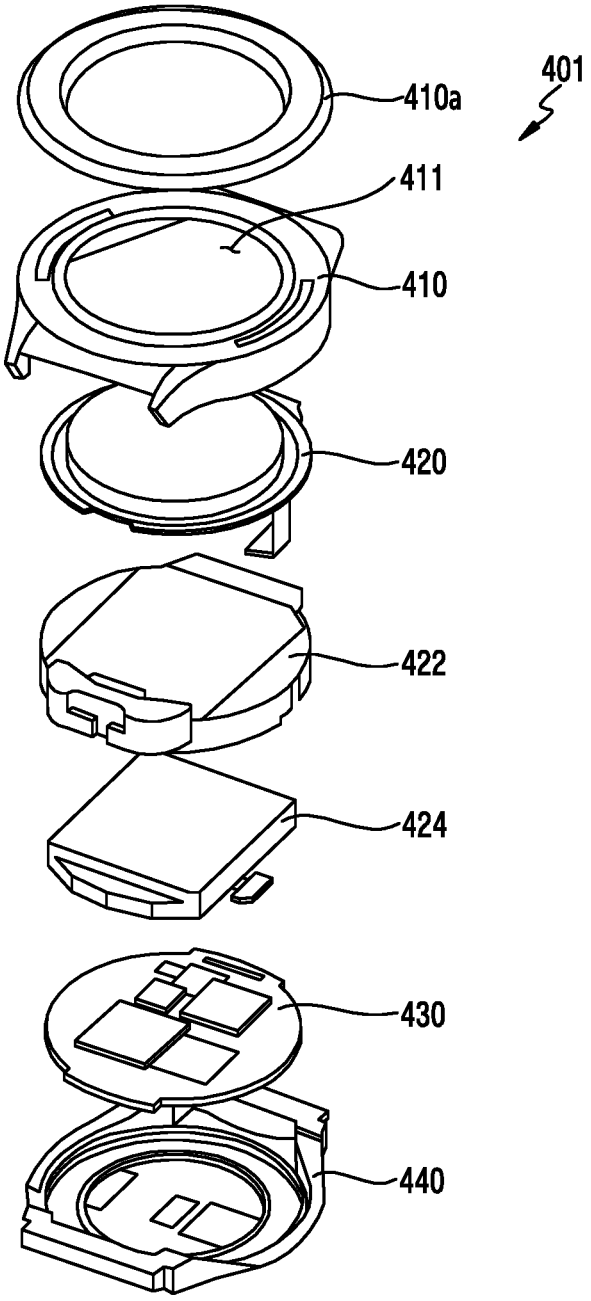

FIGS. 4A and 4B are a perspective view and an exploded view, respectively, of an electronic device 401 according to an embodiment of the present disclosure. The electronic device 401 of FIG. 4A may be similar to the electronic device 301 of FIGS. 3A and 3B, or may be another embodiment of an electronic device.

Referring to FIGS. 4A and 4B, the electronic device 401 may include a housing 410, a display 420, a bracket 422, a battery 424, a board 430 (e.g. a PCB), and a back cover 440.

According to an embodiment of the present disclosure, the housing 410 may protect various elements (e.g., the display 420, the battery 422, the board 430, etc.) that are disposed therein. The housing 410 may include a bezel wheel 410*a* that is disposed around the through-hole 411 thereof through which the display 420 is exposed. The bezel wheel 410*a* may prevent the outer peripheral area of the display 420 from being exposed to the outside, or may rotate to generate a user input.

According to an embodiment of the present disclosure, the display 420 may have a circular plate shape with a predetermined thickness, and may output images, texts, or the like. The display 420 may be implemented in various types, such as an LCD type, an OLED type, an OCTA type, or the like. In a case where the display 420 includes a touch panel, the display 420 may receive a user's touch input and may provide the touch input to a processor that is mounted on the board 430.

According to an embodiment of the present disclosure, the ground area (e.g., an flexible printed circuit board (FPCB), a shielding layer, a heat dissipation layer, etc.) of the display 420 may be connected to the ground area of the board 430 in order to ensure sufficient antenna performance. A ground pattern may be configured in a tail shape from the ground area of the display 420. The ground pattern having a tail shape may be positioned on the bracket 422 and may be electrically connected to one surface of the board 430. Through an electrical connection between the ground area of the display 420 and the ground area of the board 430, it is possible to prevent the display 420 from acting as an element that disturbs the transmission/reception of electric waves.

According to an embodiment of the present disclosure, the display 420 may be configured in a stack structure that includes a touch panel, a display panel, an adhesive layer, a ground layer, an FPCB, and the like. An NFC antenna (or an NFC coil) may be disposed inside the display 420.

According to an embodiment of the present disclosure, the display 420 may include signal lines for transmitting and receiving data with the board 430. The display 420 may include a signal line (e.g., an FPCB) relating to the supply of a signal to a display panel, a signal line relating to the supply of a signal to a touch screen, a signal line for transmitting/receiving NFC signals, a signal line for grounding, and the like, which are disposed to protrude from the display 420.

According to an embodiment of the present disclosure, the bracket 422 may couple or fix the display 420, the battery 424, the board 430, and the like. The bracket 422 may couple and fix the signal lines that connect the respective elements. The bracket 422 may be implemented with a non-conductive material (e.g., plastic).

According to an embodiment of the present disclosure, the battery 424 may be mounted on the bracket 422 and may be electrically connected with the board 430. The battery 424 may be recharged with electrical power from an external power source, and may supply electrical power to the electronic device 401.

According to an embodiment of the present disclosure, the board 430 may be equipped with modules or ICs required for operating or driving the electronic device 401. The board 430 may be equipped with a processor, a memory, a communication module, or the like. The board 430 may include a feeding part that is capable of supplying electrical power to an antenna radiator, and may include a ground area.

According to an embodiment of the present disclosure, the feeding part may be connected to the housing 410. In this case, the housing may operate as an antenna radiator, and may be electrically connected with an RF module of the board 430.

According to an embodiment of the present disclosure, the ground area of the board 430 may be connected to the ground area (e.g., an FPCB, a shielding layer, a heat dissipation layer, etc.) of the display 420. Furthermore, the ground area of the board 430 may also be connected to the housing 410.

According to an embodiment of the present disclosure, the back cover 440 may be coupled with the housing 410 to fix and protect the internal elements. The back cover 440 may be formed of a non-metallic or non-conductive material. Without being limited thereto, however, the back cover 440 may also be formed of a conductive material that is disposed to be electrically insulated from the housing 410 through a separate insulating member.

Figure 5:
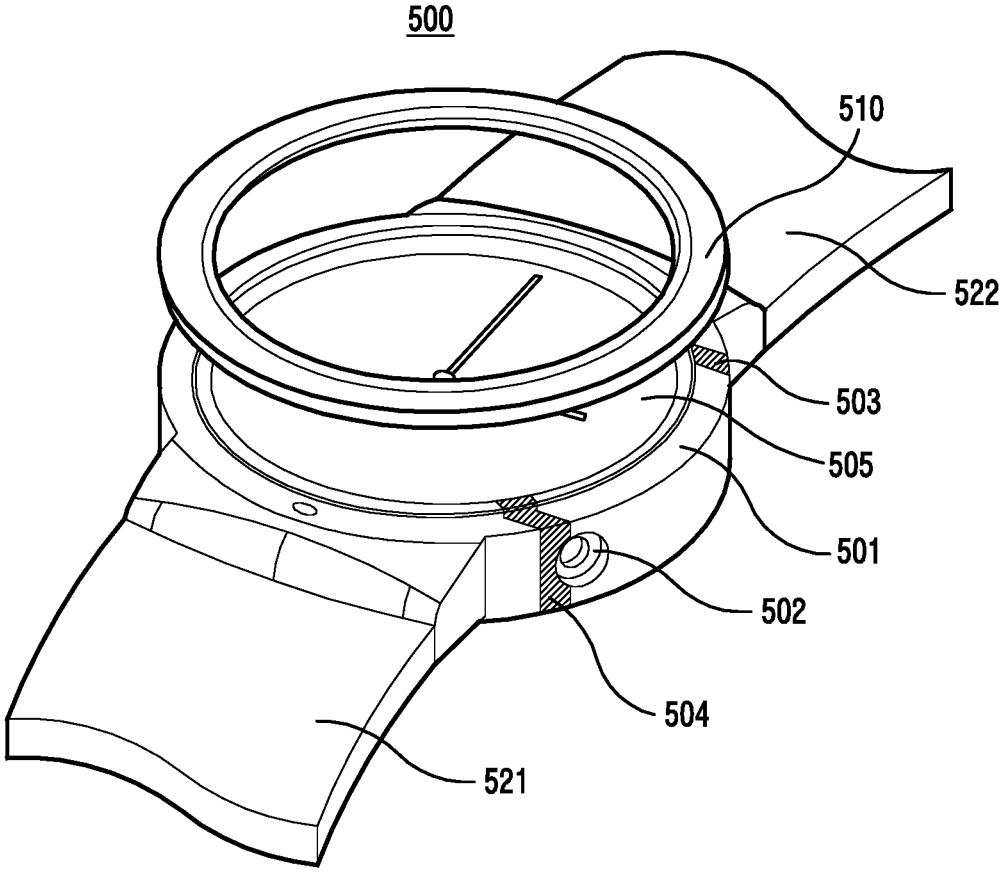
FIG. 5 is a perspective view of a housing of an electronic device that is used as an antenna according to an embodiment of the present disclosure.

FIG. 5 is a perspective view of a housing of an electronic device 500 that is used as an antenna according to an embodiment of the present disclosure.

Referring to FIG. 5, the electronic device 500 may be similar to the electronic device 301 of FIGS. 3A and 3B or the electronic device 401 of FIGS. 4A and 4B, or may be another embodiment of an electronic device.

The electronic device 500 may include a housing 501, a display 505, a bezel wheel 510, and coupling members 521 and 522. According to an embodiment of the present disclosure, the housing 501 may have cut-off portions 503 and 504 and a hole 502 formed therein, and a crown may be mounted in the hole 502. The housing 501 may be formed of, for example, metal, such as a stainless steel (steel use stainless (SUS)). The coupling members 521 and 522, which are configured to be attached to, and detached from, a part of a user's body, may be connected to opposite sides of the housing 501. The material of the coupling members 521 and 522 may be leather, urethane, or ceramics. The housing 501 may include a side surface that surrounds at least a part of the display 505.

According to an embodiment of the present disclosure, the cut-off portions 503 and 504 may be formed of a non-metallic member. A capacitor may be formed by the cut-off portions 503 and 504, and the housing 501 may be divided into a first antenna and a second antenna with the cut-off portions 503 and 504 therebetween. Resonant frequencies of the first and second antennas may be changed by at least one of permittivity according to a combination of the gap, locations, and materials of the cut-off portions 503 and 504 and the thicknesses of the cut-off portions 503 and 504. Graphic objects (e.g., a minute hand, etc.) may be displayed on the display 505.

FIGS. 6A to 6E are views illustrating configurations of antennas of electronic devices and graphs depicting operating characteristics of the antennas according to various embodiments of the present disclosure.

Figure 6A:
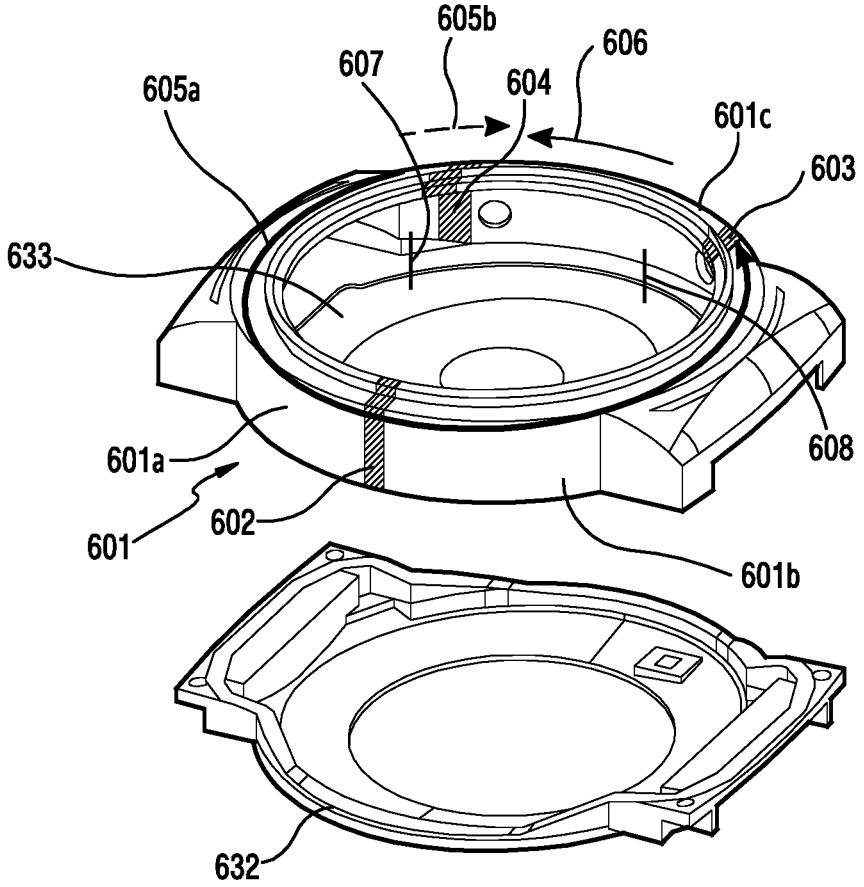
FIGS. 6A to 6E are views illustrating configurations of antennas of electronic devices and graphs depicting operating characteristics of the antennas according to various embodiments of the present disclosure.
Figure 6B:
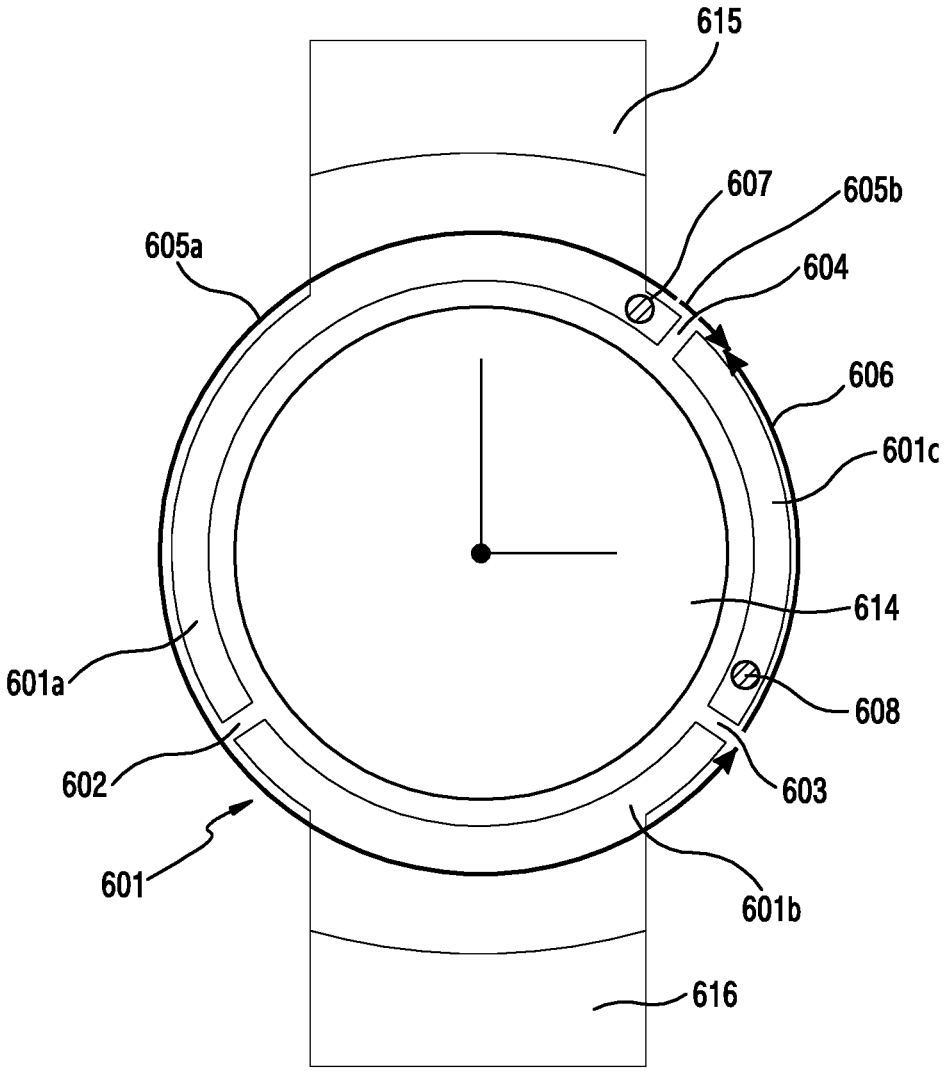

Referring to FIGS. 6A and 6B, the antenna may include a housing 601, a board 633, and a back cover 632. According to an embodiment of the present disclosure, the housing 601 may include a first conductive member 601*a*, a second conductive member 601*b*, and a third conductive member 601*c* that are separated from each other by a plurality of cut-off portions 602, 603, and 604. The cut-off portion 602 may be a first non-conductive member. The cut-off portion 603 may be a second non-conductive member. The cut-off portion 604 may be a third non-conductive member.

According to an embodiment of the present disclosure, the first conductive member 601*a* may be electrically connected to an RF module of the board 633 by a first feeding part 607. The third conductive member 601*c* may be electrically connected to the RF module of the board 633 by a second feeding part 608. The resonant frequency of the antenna may vary according to the sizes, locations, materials, and number of cut-off portions 602, 603, and 604. Furthermore, the resonant frequency of the antenna may vary according to the locations of the first and second feeding parts 607 and 608.

According to an embodiment of the present disclosure, the housing 601 may operate as a multi-band antenna that operates in a variety of bands. The first and second conductive members 601*a* and 601*b*, the cut-off portion 602, and the first feeding part 607 may be used as a radiator that operates in a first frequency band of a first antenna. The radiator may have a radiation current 605*a* that is fed by the first feeding part 607 and is radiated through the first conductive member 601*a*, the cut-off portion 602, and the second conductive member 601*b*. The first radiator may resonate in a low-frequency band and in a multiplied high-frequency band.

According to an embodiment of the present disclosure, the first and third conductive members 601*a* and 601*c*, the cut-off portion 604, and the feeding part 607 may be used as a radiator that operates in a second frequency band of the first antenna. The radiator may have a radiation current 605*b* that is fed by the first feeding part 607 and is radiated through the first conductive member 601*a*, the cut-off portion 604, and the third conductive member 601*c*. The radiator may resonate in a high-frequency band.

According to an embodiment of the present disclosure, the third conductive member 601*c* and the second feeding part 608 may be used as a radiator of a second antenna. The radiator may have a radiation current 606 that is fed by the second feeding part 608 and is radiated through the third conductive member 601*c*.

According to an embodiment of the present disclosure, the first and second radiation currents 605*a* and 605*b* of the first antenna may operate as an antenna for receiving a mobile communication band, and the radiation current 606 of the second antenna may operate as an antenna for receiving a Bluetooth band. The antenna may operate as an antenna for transmitting/receiving a mobile communication band using the first to third radiators through which the first and second radiation currents 605*a* and 605*b* flow.

According to an embodiment of the present disclosure, the resonant frequency of the antenna may vary according to the sizes, locations, materials (e.g., permittivities), and number of cut-off portions 602, 603, and 604.

According to an embodiment of the present disclosure, the board 633 may be electrically connected with the housing 601. Feeding parts corresponding to the feeding parts 607 and 608 of the housing 601 may be formed on the board 633. The feeding parts formed on the board 633 may be metallic members with resilience (e.g., a C-shaped clip or C-clip, a metal spring, etc.). A separate electrical connection member may be interposed between the housing 601 and the board 633. The electrical connection member may include one or more of various members, such as a thin cable (e.g., a metal wire), a flexible printed circuit, a C-clip, a conductive gasket, etc.

According to an embodiment of the present disclosure, coupling members 615 and 616 configured to be attached to, and detached from, a part of a user's body may be connected to opposite sides of the housing 601. The housing 601 may be disposed such that at least one area thereof is exposed externally to the electronic device.

Figure 6C:
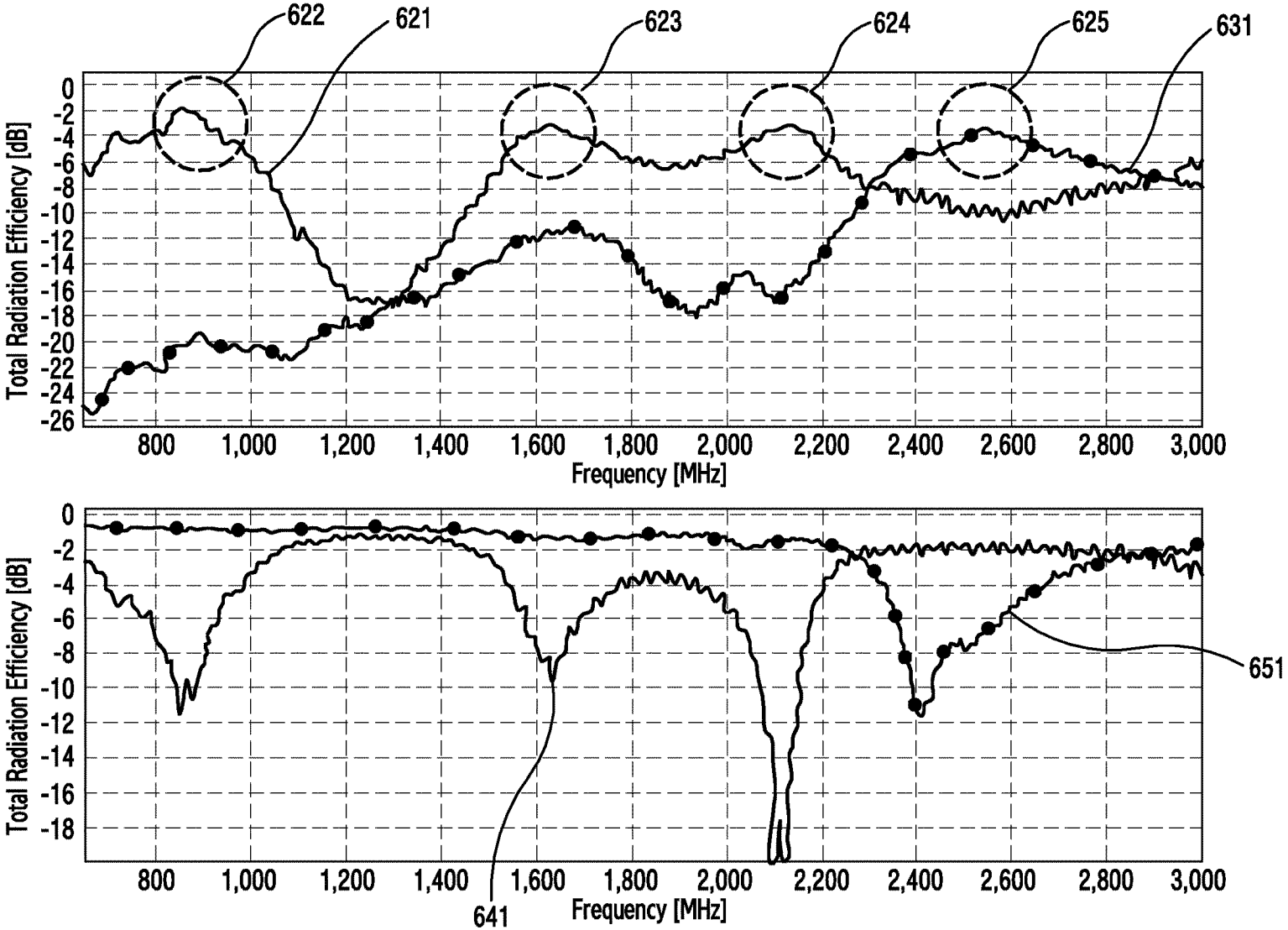

FIG. 6C are graphs 621, 631, 641, and 651 depicting operating characteristics of antennas of an electronic device according to various embodiments of the present disclosure.

Referring to FIG. 6C, the graph 621 shows antenna gain of the first antenna associated with second radiation current 605*a* according to frequency. The resonant frequency 622 may be caused by a capacitance of the antenna radiator (i.e., the first conductive member 601*a*, the second conductive member 601*b*, and the cut-off portion 602 of the housing 601) through which the low-frequency radiation current 605*a* flows. The resonant frequencies 623 and 624 may be caused by the multiplied component of the resonant frequency 622, which is formed by the low-frequency radiation current 605*a*, and the capacitance of the antenna radiator (i.e., the first and third conductive members 601*a* and 601*c* and the cut-off portion 604 of the housing 601), which is formed by the radiation current 605*a*.

According to an embodiment of the present disclosure, the graph 631 shows antenna of the second antenna associated with radiation current 606 according to frequency. The resonant frequency 625 may be caused by the electrical length of the feeding part 608 of the second antenna associated with the radiation current 606 and the electrical length of the third conductive member 601*c*, which is an antenna radiator.

Figure 6D:
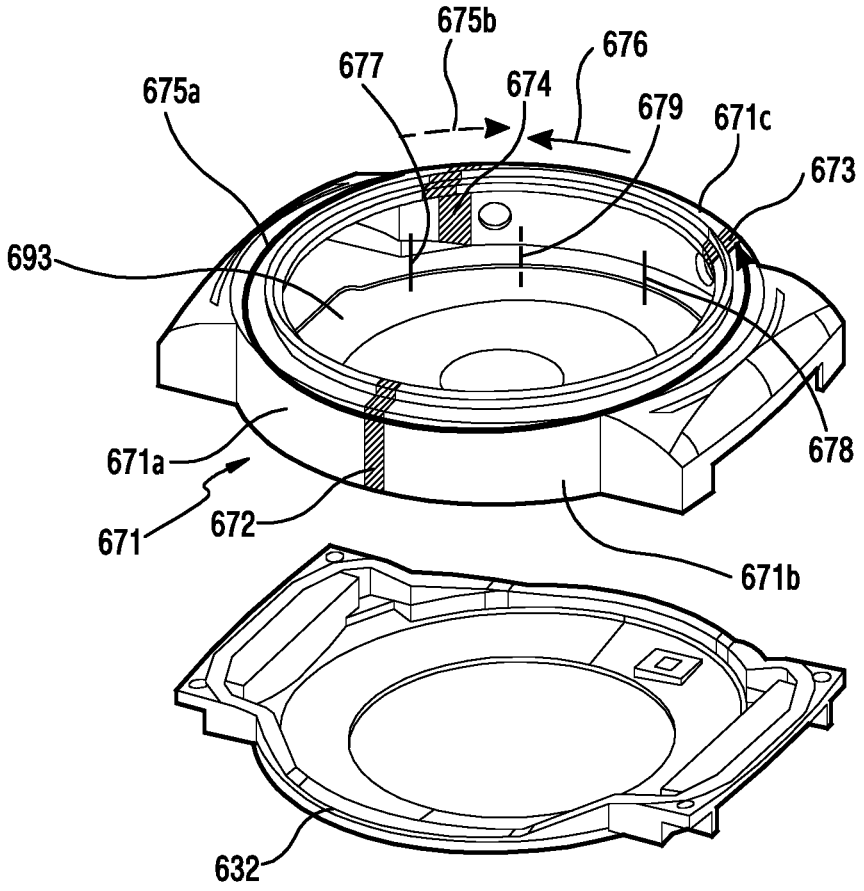
Figure 6E:
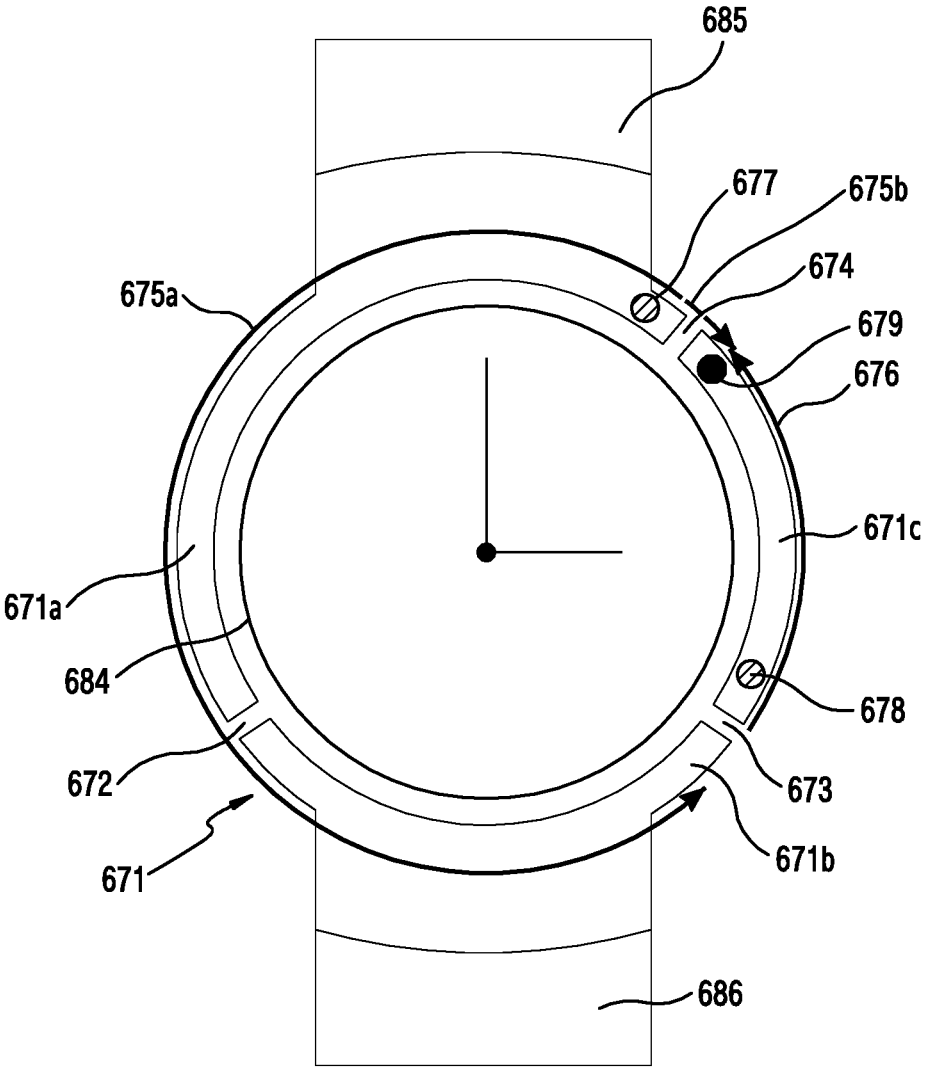

Referring to FIGS. 6D and 6E, an antenna may include a housing 671, a board 693, and a back cover 632. According to an embodiment of the present disclosure, the housing 671 may include first to third conductive members 671*a*, 671*b*, and 671*c* that are separated from each other by a plurality of cut-off portions 672, 673, and 674. The cut-off portion 672 may be a first non-conductive member. The cut-off portion 673 may be a second non-conductive member. The cut-off portion 674 may be a third non-conductive member. According to an embodiment of the present disclosure, coupling members 685 and 686 configured to be attached to, and detached from, a part of a user's body may be connected to opposite sides of the housing 671.

According to an embodiment of the present disclosure, the first conductive member 671*a* may be electrically connected to the board 693 by a first feeding part 677. The third conductive member 671*c* may be electrically connected to the board 693 by a second feeding part 678, and may be grounded to the board 693 by a ground part 679 that is spaced apart from the second feeding part 678. A resonant frequency of the antenna may vary according to the sizes, locations, materials, and number of cut-off portions 672, 673, and 674. Furthermore, the resonant frequency of the antenna may vary according to the locations of the first and second feeding parts 677 and 678 and the location of the ground part 679.

According to an embodiment of the present disclosure, the housing 671 may operate as a multi-band antenna that operates in a variety of bands.

According to an embodiment of the present disclosure, the first and second conductive members 671*a* and 601*b*, the first cut-off portion 672, and the first feeding part 677 may be used as a radiator that operates in the first frequency band of a first antenna. The radiator may have a radiation current 675*a* that is fed by the first feeding part 677 and is radiated through the first conductive member 671*a*, the cut-off portion 672, and the second conductive member 671*b*. The radiator may resonate in a low-frequency band and in a multiplied high-frequency band.

According to an embodiment of the present disclosure, the first and third conductive members 671*a* and 671*c*, the third cut-off portion 674, the first feeding part 677, and the ground part 679 may be used as a radiator that operates in a second frequency band of the first antenna. The radiator may have a radiation current 675*b* that is fed by the first feeding part 677 and is grounded to the board 693 through the first conductive member 671*a*, the cut-off portion 674, the third conductive member 671*c*, and the ground part 679. The radiator may resonate in a high-frequency band.

According to an embodiment of the present disclosure, the first antenna may have a monopole antenna structure, and may have an analogous inverted-F antenna (IFA) structure by virtue of the ground part 679 so that the wavelength thereof may increase.

According to an embodiment of the present disclosure, the antenna may include a second antenna that has a radiation current 676 that is fed by the second feeding part 678 and is grounded to the board 693 through the third conductive member 671*c* and the ground part 679. The second antenna may have a loop-shaped structure.

According to an embodiment of the present disclosure, the first and second radiation currents 675*a* and 675*b* of the first antenna may operate as an antenna for receiving a mobile communication band, and the radiation current 676 of the second antenna may operate as an antenna for receiving a Bluetooth band.

According to an embodiment of the present disclosure, the resonant frequency of the antenna may vary according to the sizes, locations, materials (e.g., permittivities), and number of cut-off portions 672, 673, and 674.

According to an embodiment of the present disclosure, the board 693 may be electrically connected with the housing 671. A feeding part corresponding to the feeding part 678 of the housing may be formed on the board 693. The feeding part formed on the board 693 may be a metallic member with resilience. A separate electrical connection member may be interposed between the housing 671 and the board 693. The electrical connection member may include one or more of various members, such as a thin cable (e.g., a metal wire), a flexible printed circuit, a C-clip, a conductive gasket, etc.

FIGS. 7A to 7F are views illustrating various configurations of antennas in accordance with locations of cut-off portions in housings of electronic devices according to various embodiments of the present disclosure and graphs depicting operating characteristics of the antennas.

Figure 7A:
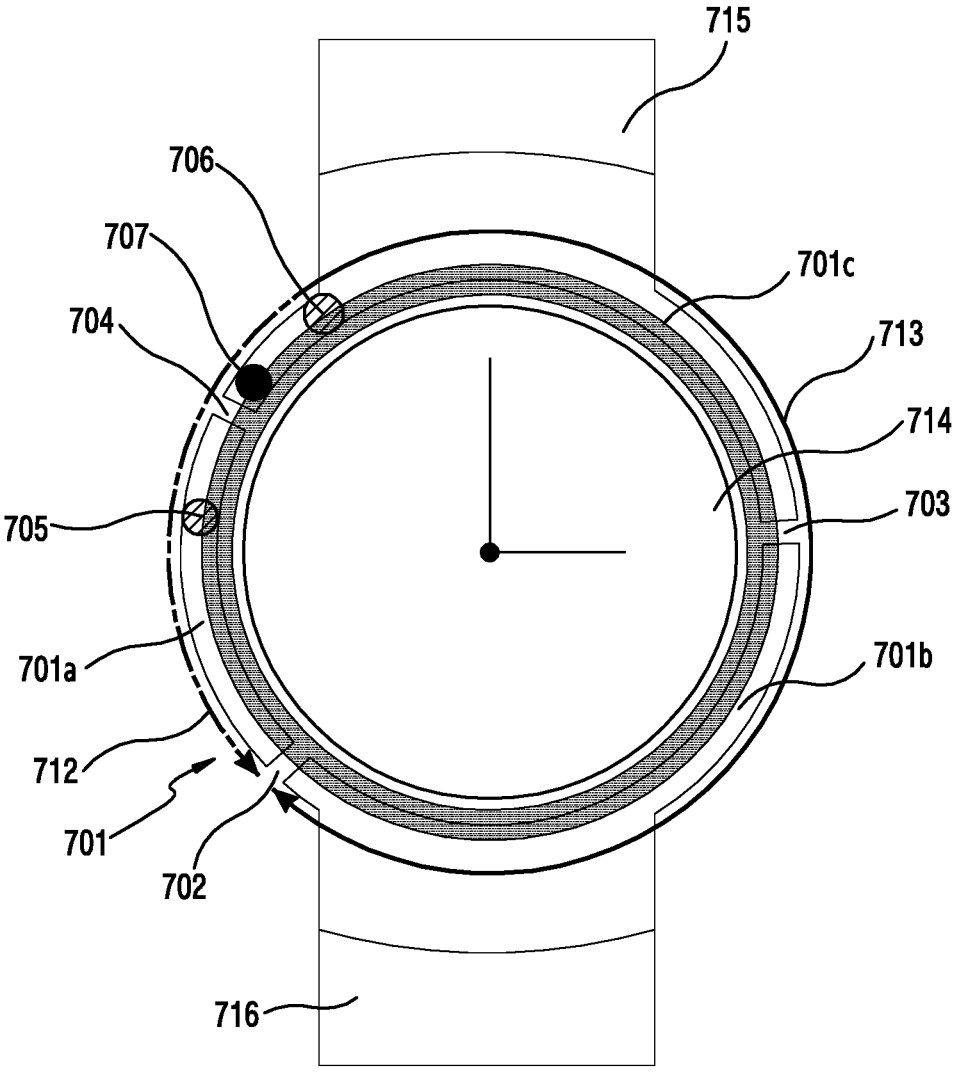
FIGS. 7A to 7F are views illustrating various configurations of antennas in accordance with locations of cut-off portions in housings of electronic devices according to various embodiments of the present disclosure and graphs depicting operating characteristics of the antennas.

Referring to FIG. 7A, an electronic device may include a housing 701, a plurality of cut-off portions 702, 703, and 704, feeding parts 705 and 706, a ground part 707, a display 714, and coupling members 715 and 716.

According to an embodiment of the present disclosure, the housing 701 may include first to third conductive members 701*a*, 701*b*, and 701*c* that are separated from each other by the plurality of cut-off portions 702, 703, and 704. The cut-off portion 702 may be a first non-conductive member. The cut-off portion 703 may be a second non-conductive member. The cut-off portion 704 may be a third non-conductive member. The first conductive member 701*a* may be electrically connected to an RF module of a board by the first feeding part 705. The third conductive member 701*c* may be electrically connected to the RF module of the board by the second feeding part 706, and may be grounded to the board by the ground part 707 that is spaced apart from the second feeding part 706.

According to an embodiment of the present disclosure, the housing 701 may operate as a multi-band antenna that operates in a variety of bands.

According to an embodiment of the present disclosure, the second and third conductive members 701*b* and 701*c*, one end portion of the first conductive member 701*a*, the cut-off portions 703 and 704, the feeding part 706, and the ground part 707 may form a first antenna 713. The housing 701, the feeding part 705, and the ground part 707 may form a second antenna 712.

Figure 7B:
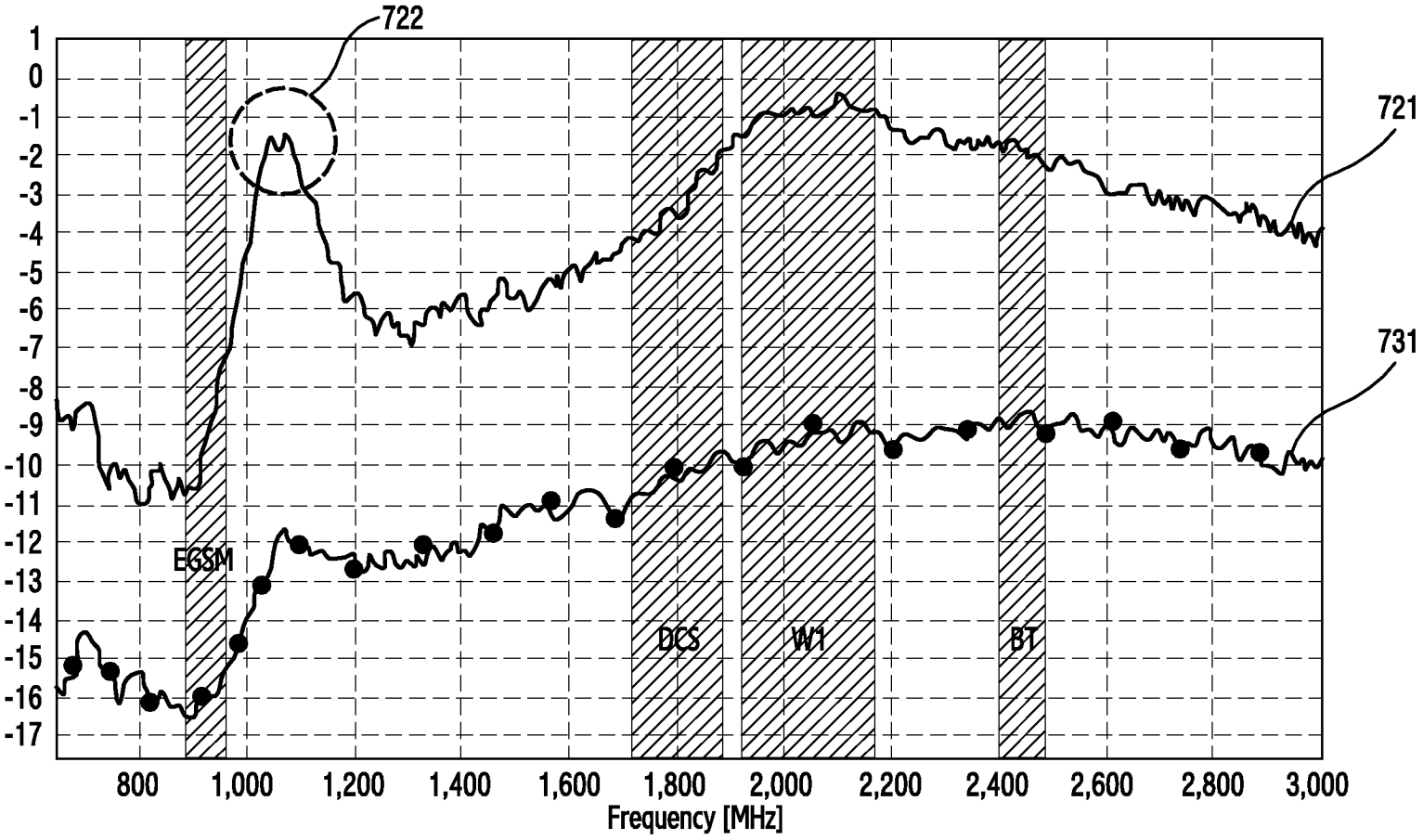

FIG. 7B are graphs depicting frequency characteristics of the first and second antennas 713 and 712. According to an embodiment of the present disclosure, the graph 721 shows antenna gain of the first antenna 713 according to frequency. The resonant frequency 722 may be determined according to the lengths of the second and third conductive members 701*b* and 701*c* and the locations of the cut-off portions 702 and 704, the feeding part 705, and the ground part 707.

The graph 731 shows the antenna gain of the second antenna 712 according to frequency.

Figure 7C:
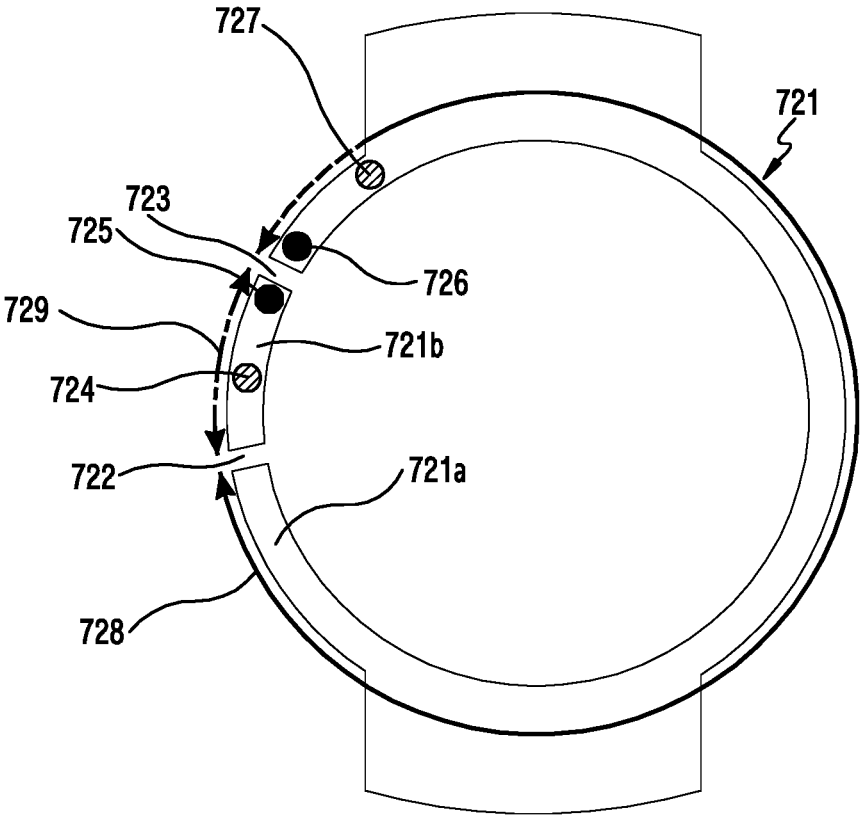

Referring to FIG. 7C, an antenna may include a housing 721, cut-off portions 722 and 723, feeding parts 724 and 727, and ground parts 725 and 726. According to an embodiment of the present disclosure, the housing 721 may include first and second conductive members 721*a* and 721*b* that are separated from each other by the cut-off portions 722 and 723. The housing 721 may serve as an IFA. The IFA may include the first conductive member 721*a* that serves as a first antenna and the second conductive member 721*b* that serves as a second antenna.

According to an embodiment of the present disclosure, the first conductive member 721*a* may be electrically connected to an RF module of a board by the first feeding part 727, and may be grounded to the board by the first ground part 726 that is spaced apart from the first feeding part 727. The second conductive member 721*b* may be electrically connected to the RF module of the board by the second feeding part 724, and may be grounded to the board by the second ground part 725 that is spaced apart from the second feeding part 724.

According to an embodiment of the present disclosure, the housing 721 may operate as a multi-band antenna that operates in a variety of bands. The first conductive member 721*a*, the feeding part 727, and the ground part 726 may form the first antenna 728. The second conductive member 721*b*, the feeding part 724, and the ground part 725 may form the second antenna 729.

Figure 7D:
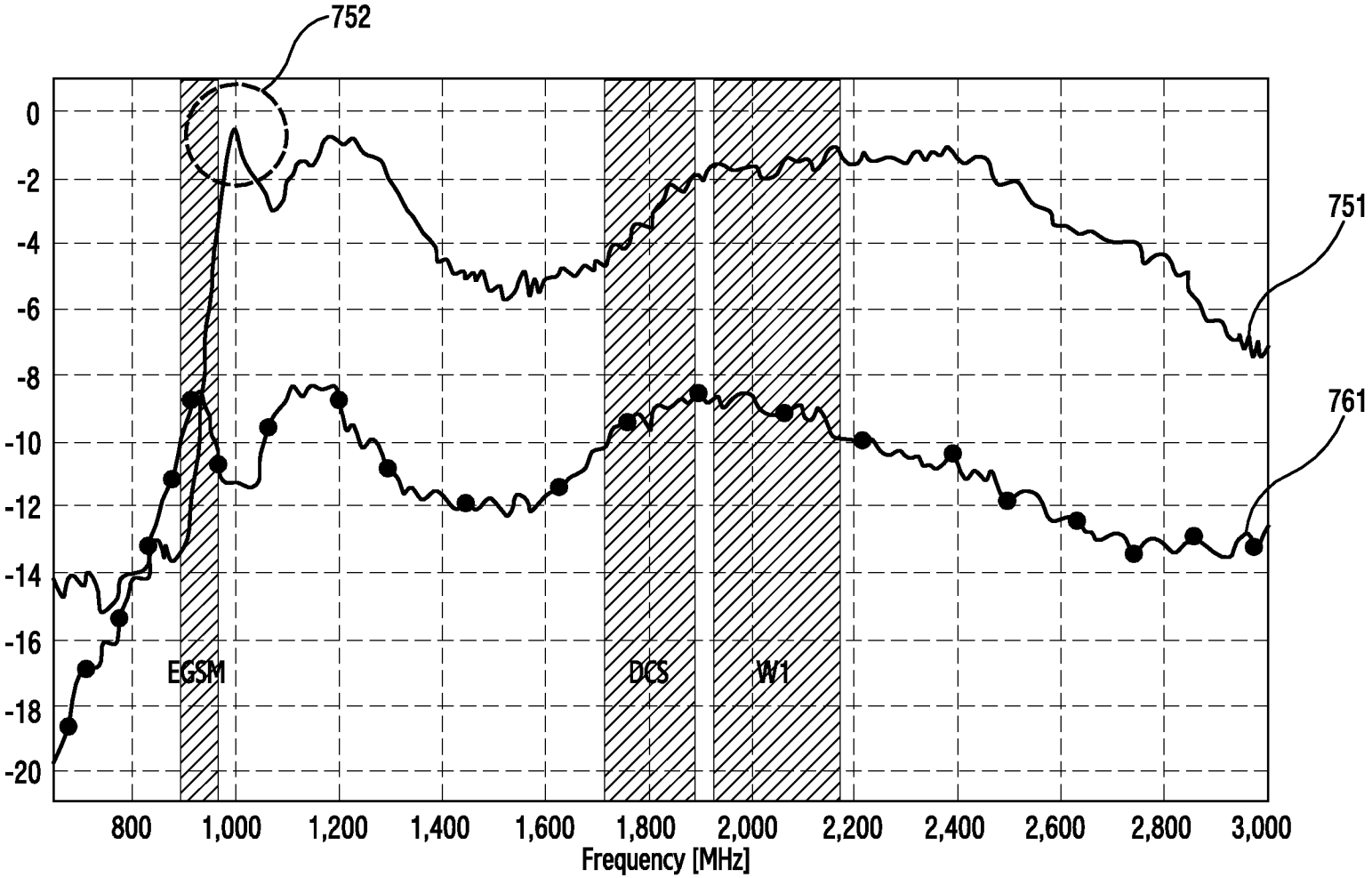

FIG. 7D are graphs depicting frequency characteristics of the first and second antennas 728 and 729. The graph 751 shows a variation in gain of the first antenna 728 according to frequency. The resonant frequency 752 may be determined according to the length of the first conductive member 721*a* and the locations of the feeding part 727 and the ground part 726. The resonant frequency 752 may be similar to the resonant frequency 722 of FIG. 7B. For example, the resonant frequencies made by the first antenna of FIG. 7A and the first antenna of FIG. 7C may be similar to each other. The second and third conductive members 701*b* and 701*c* of the first antenna of FIG. 7A may be shorter than the first conductive member 701*a* of the first antenna of FIG. 7C. By using the cut-off portions, the first antenna of FIG. 7A may be made shorter while making the same resonant frequency. For example, an effect of increasing the electrical length of the antenna may be obtained by adding a cut-off portion to the housing.

Figure 7E:
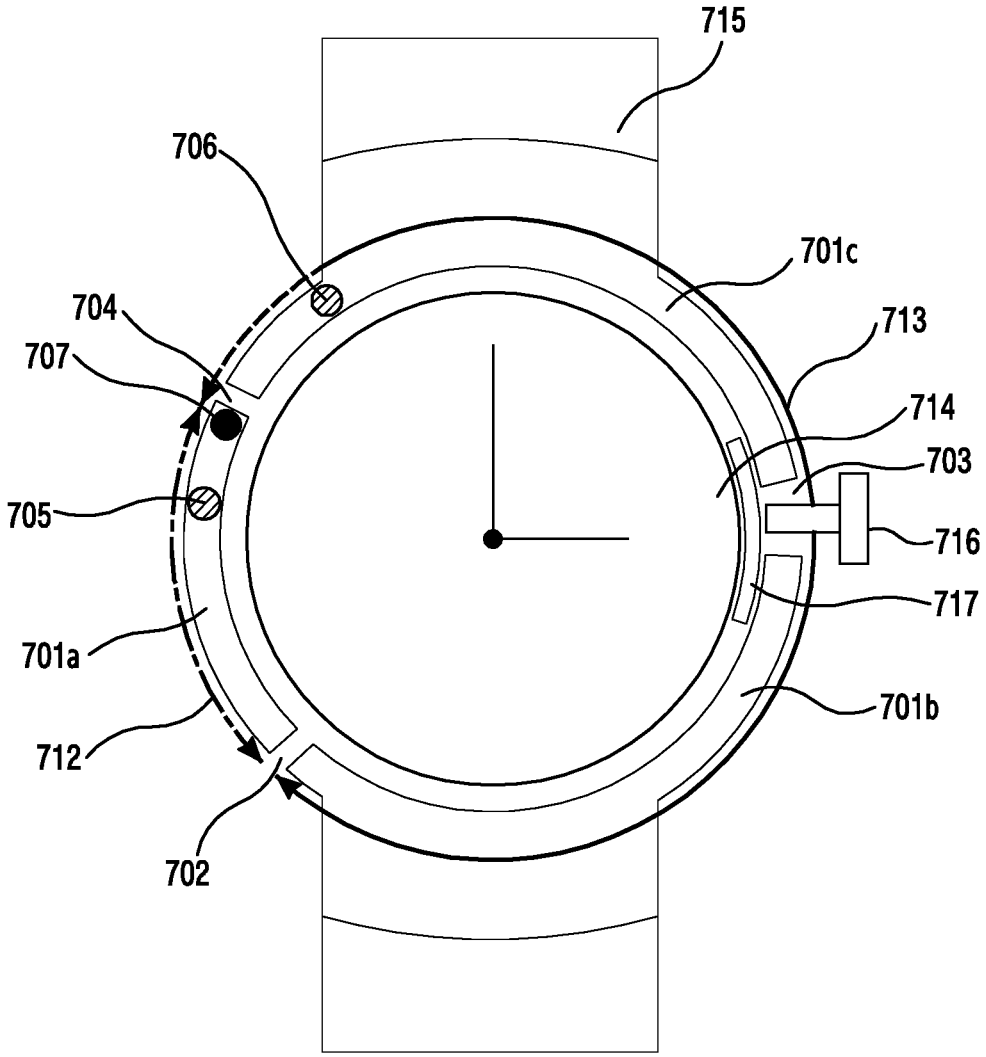

Referring to FIG. 7E, first to third conductive members 701*a*, 701*b*, and 701*c*, cut-off portions 702, 703, and 704, a crown 716, a display 714, and a coupling member 715 are illustrated.

According to an embodiment of the present disclosure, the first conductive member 701*a*, a feeding part 705, and a ground part 707 may form a first antenna. The first conductive member 701*a* may be electrically connected to an RF module of a board by the first feeding part 705, and may be electrically connected to the RF module of the board by the first ground part 707 that is spaced apart from the first feeding part 705.

According to an embodiment of the present disclosure, the second conductive member 701*b*, the third conductive member 701*c*, the cut-off portion 703, a metallic member 717, and a feeding part 706 may form a second antenna. The second feeding part 706 may be electrically connected to the RF module of the board. The cut-off portion 703 may be formed in the hole in which the crown 716 is mounted, and may not be exposed externally of the electronic device.

Graphic objects, such as an hour hand and a minute hand, may be displayed on the display 714.

Figure 7F:
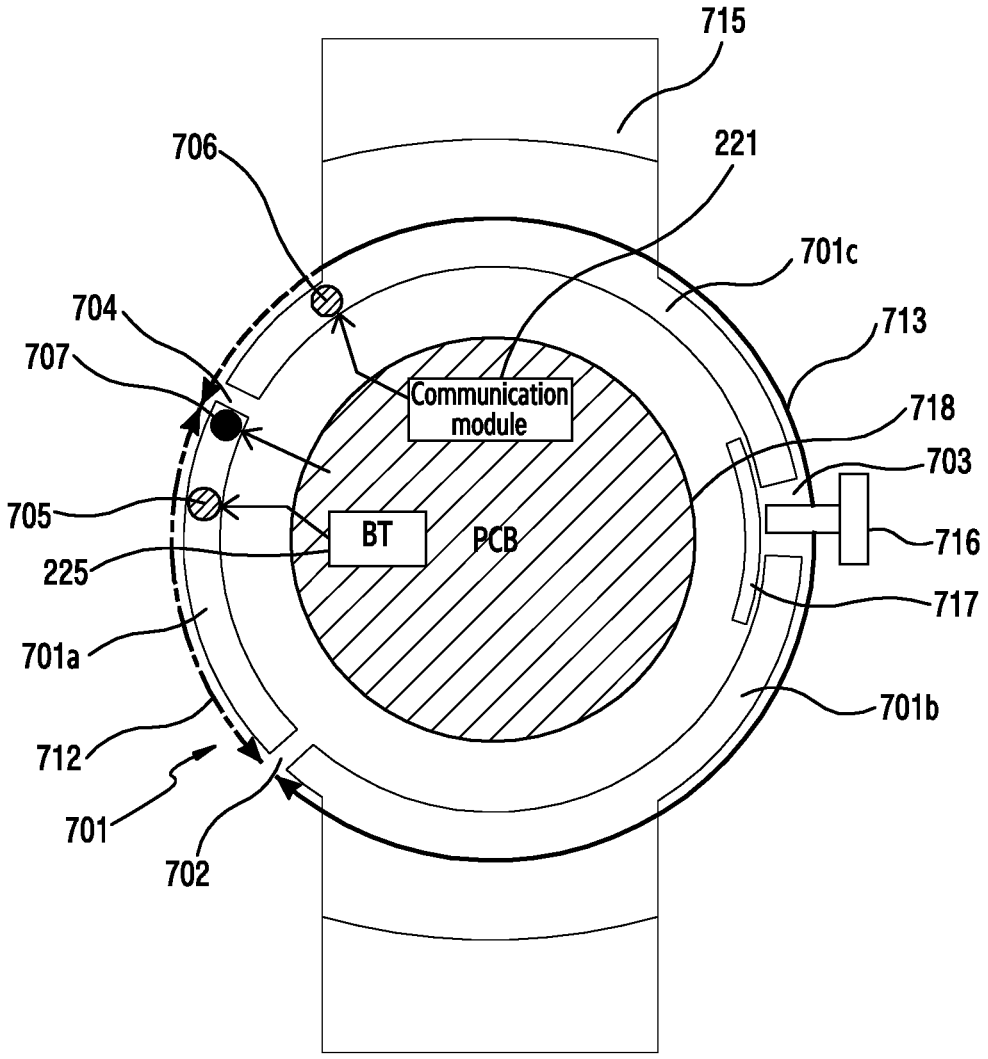

Referring to FIG. 7F, first to third conductive members 701*a*, 701*b*, and 701*c*, cut-off portions 702, 703, and 704, a crown 716, a board 718, and a coupling member 715 are illustrated.

According to an embodiment of the present disclosure, communication modules 221 and 225 (e.g., a Front End Module (FEM), a Bluetooth module, etc.) may be disposed on the board 718.

According to an embodiment of the present disclosure, the first conductive member 701*a* may be connected to the module (e.g., a short-range communication module) on the board 718 through a first feeding part 705, and may be grounded to the board 718 by a ground part 707 that is spaced apart from the first feeding part 705.

According to an embodiment of the present disclosure, the second conductive member 701*b* may be connected to the communication module (e.g., an FEM, an RF module, a cellular module, etc.) on the board 718 by a second feeding part 706.

According to an embodiment of the present disclosure, a housing 701 may operate as a multi-band antenna that operates in a variety of bands. A first antenna may have a radiation area 712 that is electrically connected to the first feeding part 705 and is radiated through the first conductive member 701*a* and the first ground part 707. The first feeding part 705 may be connected to a BT module on the board 718.

According to an embodiment of the present disclosure, a second antenna may have a radiation area 713 that is electrically connected to the second feeding part 706 and is radiated through the third conductive member 701*c*, a metallic member 717, and the second conductive member 701*b*. The second feeding part 706 may be connected to the communication module 221 (e.g., an RF module, an FEM, etc.) on the board 718.

According to an embodiment of the present disclosure, the coupling member 715 may be connected to opposite sides of the housing 701, and may be connected to be attached to, and detached from, a part of a user's body. The material of the coupling member 715 may be, for example, leather, urethane, or ceramics.

According to an embodiment of the present disclosure, the cut-off portion 703 may be formed in a hole in which the crown 716 is mounted, and may not be exposed externally of the electronic device. The metallic member 717 may be formed in the hole in which the crown 716 is mounted, and may increase a capacitance.

Figure 8A:
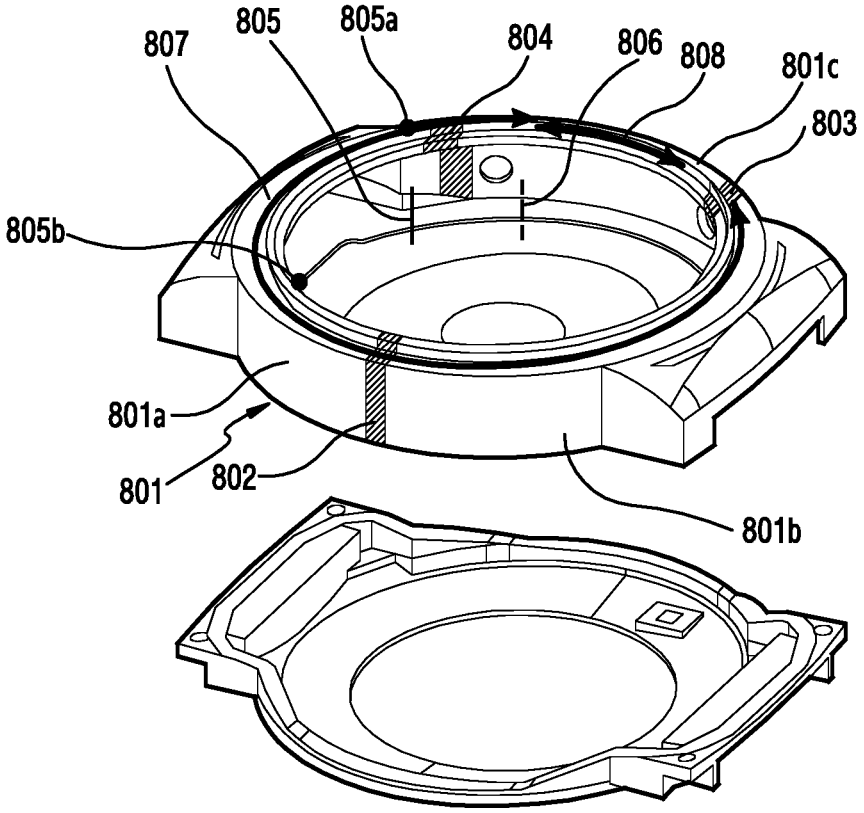
FIGS. 8A to 8C are a view and graphs of operating characteristics of an antenna in accordance with locations of a feeding part and a ground part according to various embodiments of the present disclosure.
Figure 8B:
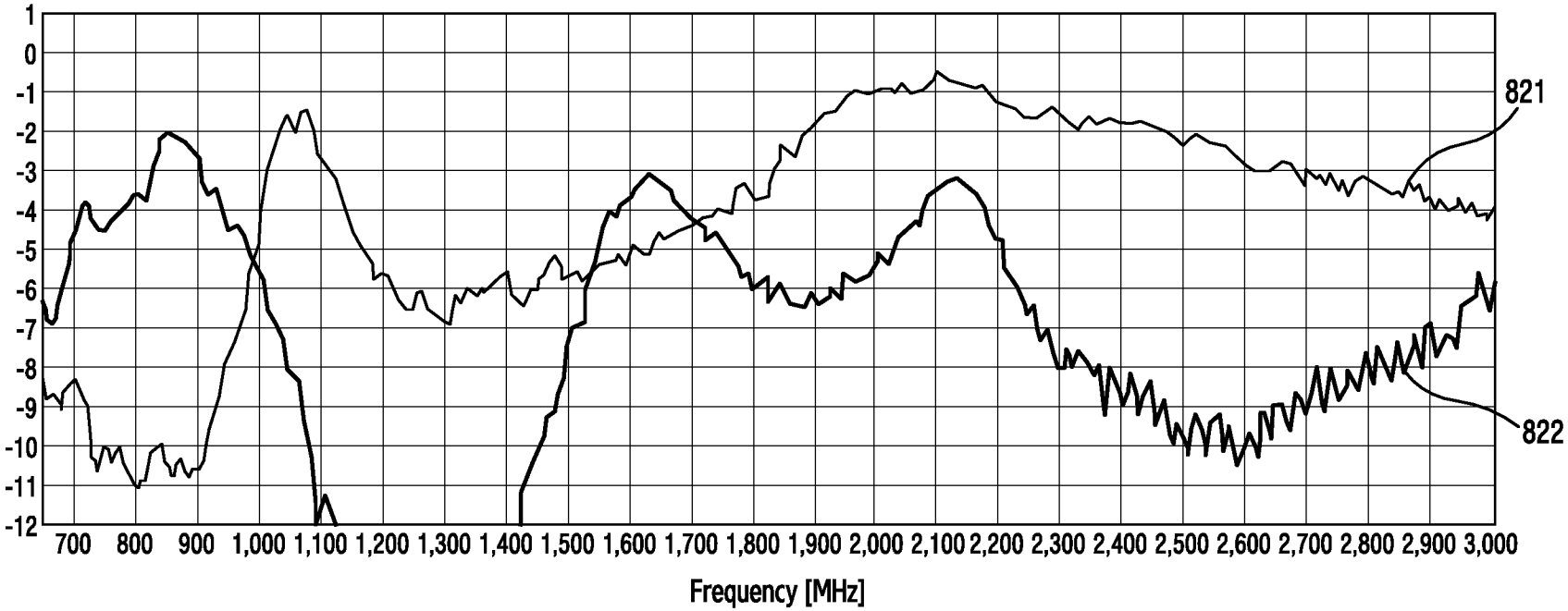
Figure 8C:
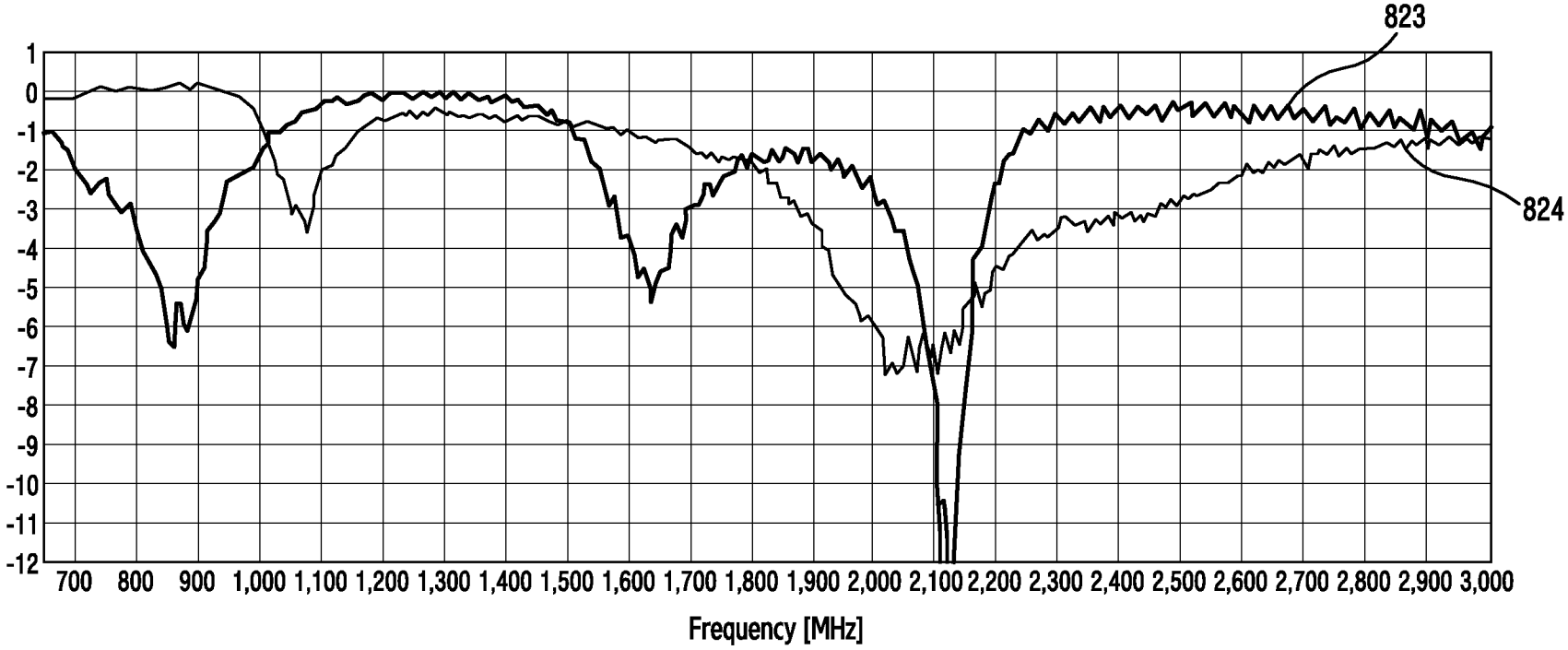

FIGS. 8A to 8C are a view and graphs of operating characteristics of an antenna in accordance with locations of a feeding part and a ground part according to various embodiments of the present disclosure.

Since a wearable electronic device has a limitation in size, it is difficult to ensure an antenna length that is sufficient for low-frequency resonance. According to an embodiment of the present disclosure, an antenna length for low-frequency resonance may be ensured by forming cut-off portions in a housing and using a coupling capacitor of cut-off portions. Alternatively, an electronic device may determine a resonance location in a high-frequency band by varying locations of a feeding part and a ground part that are formed in a housing.

Referring to FIG. 8A, an antenna may include a housing 801. According to an embodiment an embodiment of the present disclosure, the housing 801 may include conductive members 801*a*, 801*b*, and 801*c* that are separated from each other by one or more cut-off portions 802, 803, and 804. The cut-off portion 802 may be a first non-conductive member. The cut-off portion 803 may be a second non-conductive member. The cut-off portion 804 may be a third non-conductive member.

According to an embodiment an embodiment of the present disclosure, the first conductive member 801*a* may be electrically connected to an RF module of a board by a feeding part 805. The third conductive member 801*c* may be grounded to the board by a ground part 806. A resonant frequency of the antenna may vary according to the sizes, locations, materials, and number of cut-off portions 802, 803, and 804.

According to an embodiment of the present disclosure, the location of the feeding part 805 may vary within the range 807 of the first conductive member 801*a*. The location of the ground part 806 may vary within the range 808 of the third conductive member 801*c*.

According to an embodiment of the present disclosure, the electronic device may change the frequency band of the housing 801, which operates as an antenna, by varying the locations of the feeding part 805 and the ground part 806. The electronic device may change the resonant frequency in a high-frequency band by varying the locations of the feeding part 805 and the ground part 806. The electronic device may change the resonant frequency in a low-frequency band by varying the locations of the cut-off portions 802, 803, and 804 that are formed in the housing 801.

For example, when the feeding part 805 formed on the first conductive member 801*a* is moved from 805*a* to 805*b*, the length of the resonance current flow 807 varies and the electrical length decreases so that the resonant frequency may operate in a higher-frequency band than that in the related art.

FIG. 8B shows a graph 821 depicting antenna gain of a non-segmented antenna, which has no cut-off portion, according to frequency and a graph 822 depicting antenna gain of the segmented antenna 801*a*, 802, 801*b*, 805, 804, and 806, which has the cut-off portion 802 formed therein, according to frequency. Although the non-segmented antenna and the segmented antenna use the same housing, the frequency characteristics thereof may differ from each other according to the number and locations of cut-off portions. According to an embodiment of the present disclosure, the non-segmented antenna, which has no cut-off portion formed in the housing, may have two resonant frequencies, and the segmented antenna, which has the cut-off portion formed therein, may have three resonant frequencies.

According to an embodiment of the present disclosure, an operating frequency band may be adjusted by determining the electrical length of an antenna radiator by adjusting the locations of cut-off portions from a feeding part and the number of cut-off portions.

FIG. 8C shows a graph 824 depicting a reflection coefficient of the non-segmented antenna, which has no cut-off portion, according to frequency and a graph 823 depicting the reflection coefficient of the segmented antenna, which has the cut-off portion 802 formed therein, according to frequency. Although the non-segmented antenna and the segmented antenna use the same housing, the reflection coefficient characteristics thereof may differ from each other according to the number and locations of cut-off portions.

Figure 9A:
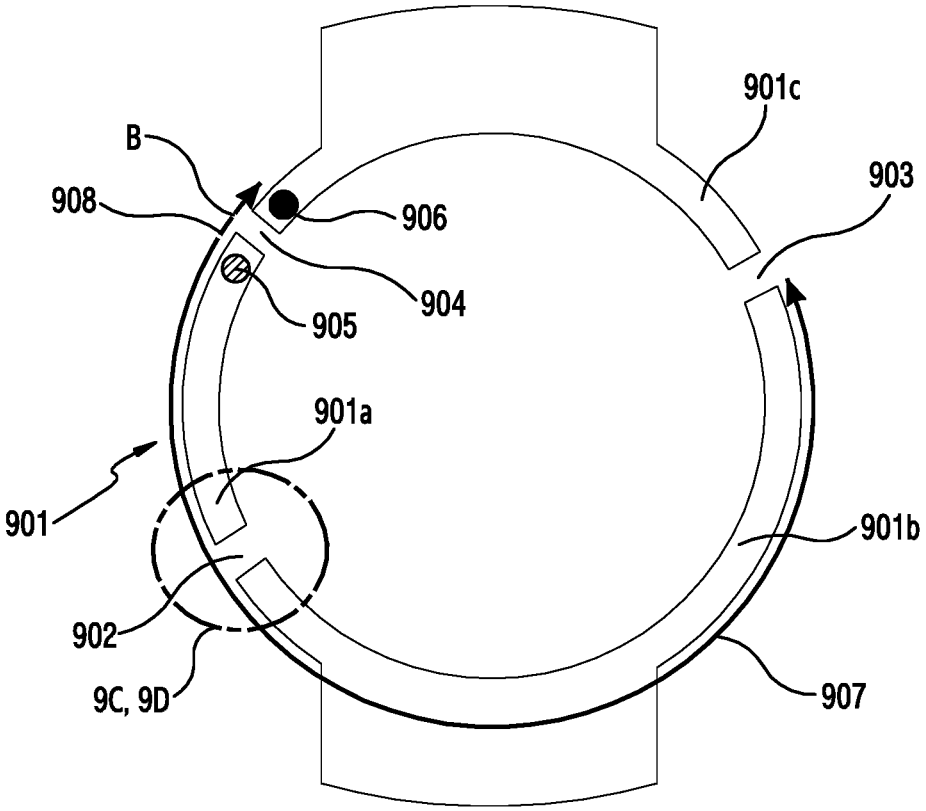
FIGS. 9A and 9B are a view illustrating a configuration of an antenna in accordance with various cut-off positions in a housing of an electronic device according to various embodiments of the present disclosure and an equivalent circuit diagram thereof.
Figure 9B:
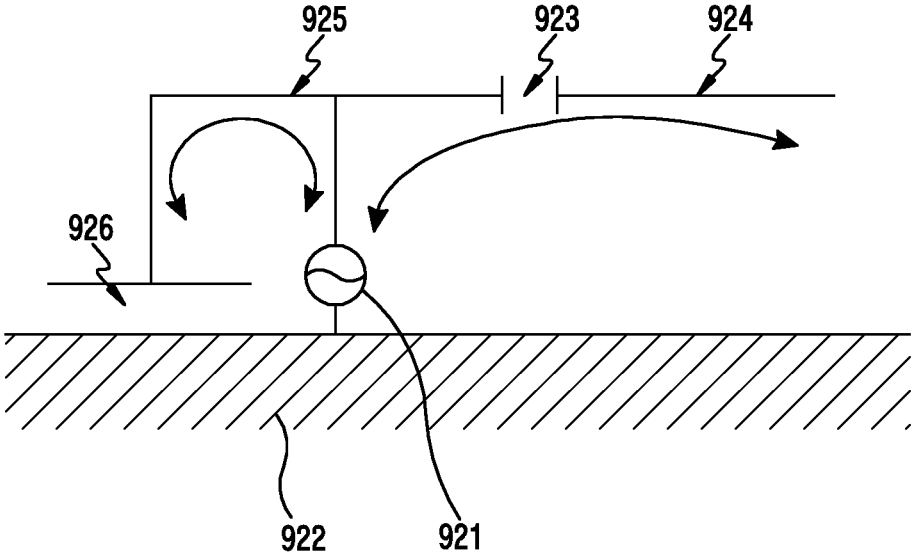

FIGS. 9A and 9B are a view illustrating a configuration of an antenna in accordance with various cut-off positions in the housing of an electronic device according to various embodiments and an equivalent circuit diagram thereof.

Referring to FIG. 9A, an antenna may include a housing 901. According to an embodiment of the present disclosure, the housing 901 may include first to third conductive members 901*a*, 901*b*, and 901*c* that are separated from each other by cut-off portions 902, 903, and 904. The cut-off portion 902 may be a first non-conductive member. The cut-off portion 903 may be a second non-conductive member. The cut-off portion 904 may be a third non-conductive member.

According to an embodiment of the present disclosure, the first conductive member 901*a* may be electrically connected to an RF module of a board by a feeding part 905. The third conductive member 901*c* may be grounded to the board by a ground part 906. A resonant frequency of the antenna may vary according to the sizes, locations, materials, and number of cut-off portions 902, 903, and 904. The antenna may include a first antenna that has a radiation current 907 in a first resonant frequency band, which is fed by the first feeding part 905 and is radiated through the first conductive member 901*a*, the cut-off portion 902, and the second conductive member 901*b*. The antenna may include a second antenna that has a radiation current 908 in a second resonant frequency band, which is fed by the first feeding part 905 and is radiated through the first conductive member 901*a*, the cut-off portion 904, and the ground part 906.

Referring to the equivalent circuit of FIG. 9B, a feeding part 921, cut-off capacitors 923 and 926, and a ground part 922 are illustrated. The cut-off capacitor 923 may correspond to the cut-off portion 902. The cut-off capacitor 926 may correspond to the cut-off portion 904. The cut-off capacitor 923 may be varied by changing the gap of the cut-off portion 902. The cut-off capacitance 926 may be varied by changing the gap of the cut-off portion 904. The feeding part 921 may correspond to the feeding part 905 of the housing 901. The ground part 922 may correspond to the ground part 906 of the housing 901. According to an embodiment of the present disclosure, the feeding part 921 and the cut-off capacitor 923 may affect a low resonant frequency band including an electrical route 924. The feeding part 921, the cut-off capacitor 926, and the ground part 922 may affect a high resonant frequency band including an electrical route 925.

Figure 9C:
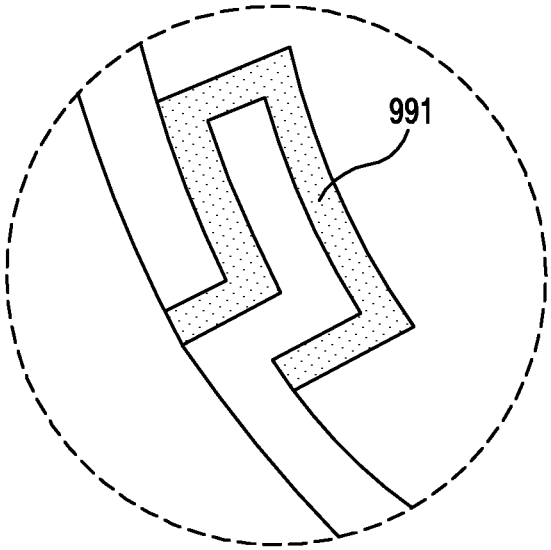
FIGS. 9C and 9D are partial views of a first cut-off portion of FIG. 9A according to various embodiments of the present disclosure.
Figure 9D:
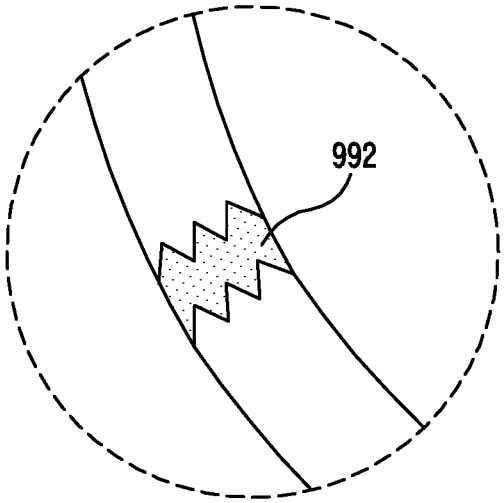

FIGS. 9C and 9D are partial views of a first cut-off portion of FIG. 9A according to various embodiments of the present disclosure. The first cut-off portion of FIG. 9A may be formed in a variety of shapes.

Referring to FIG. 9C, a capacitance may be changed (e.g., increased) by changing the shape of a part of a conductive member that corresponds to an electrode.

Referring to FIG. 9D, a capacitance may be increased by changing the sectional shape of the conductive member that corresponds to an electrode. According to an embodiment of the present disclosure, a cut-off portion may be filled with non-conductive members 991 and 992 of FIGS. 9C and 9D, respectively.

Figure 10A:
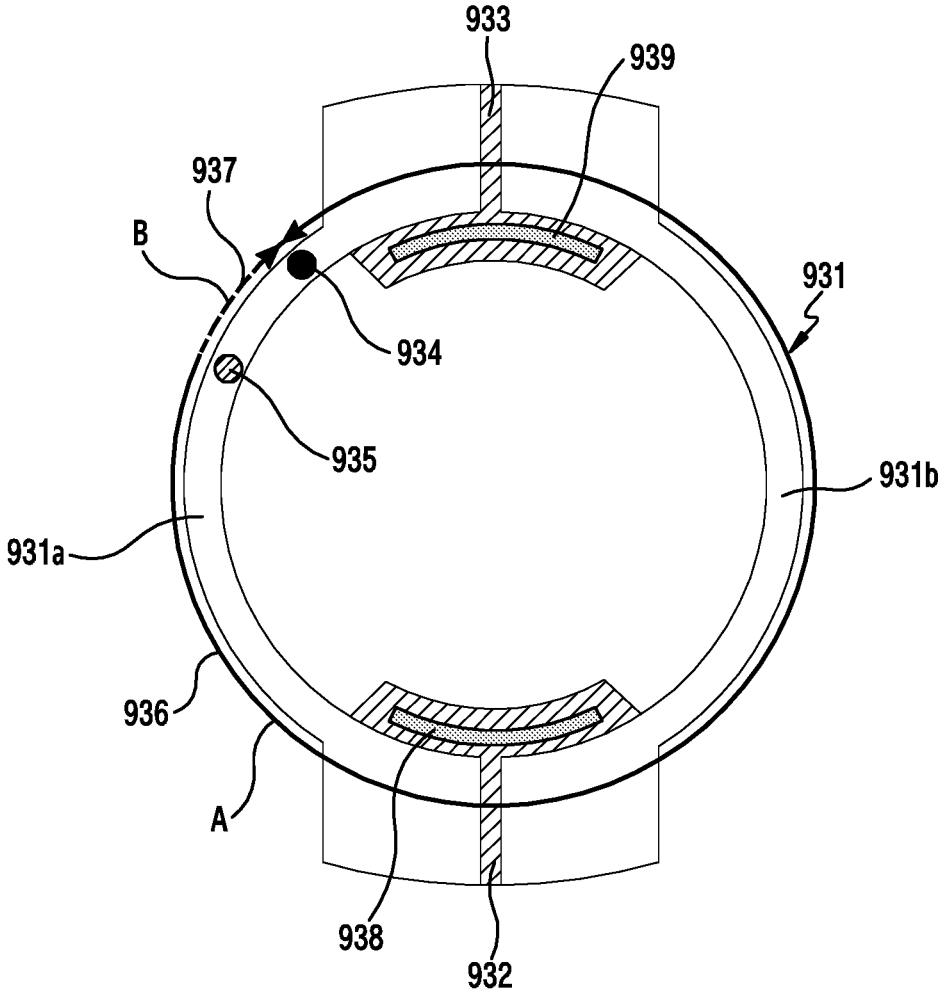
FIGS. 10A and 10B are a view illustrating a configuration of an antenna in which a conductor is disposed near a cut-off portion in a housing of an electronic device according to various embodiments of the present disclosure and an equivalent circuit diagram thereof.
Figure 10B:
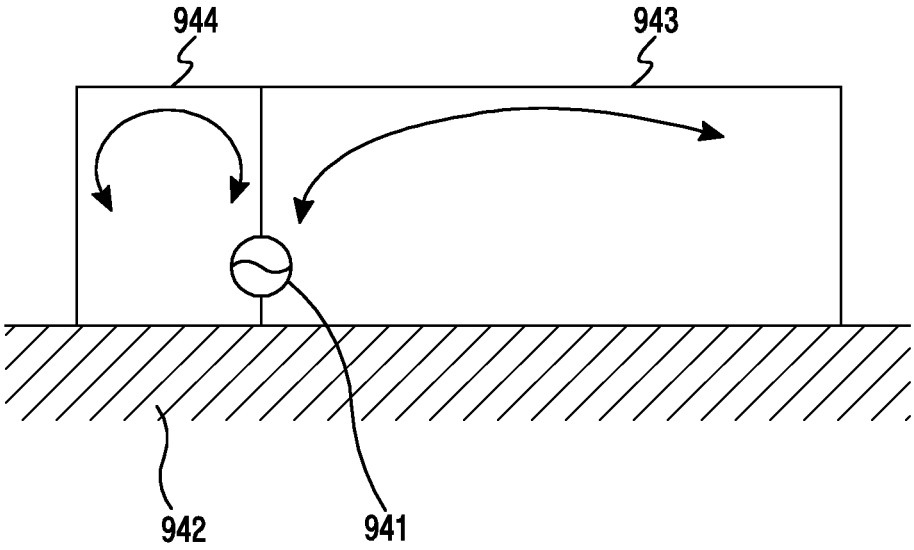

FIGS. 10A and 10B are a view illustrating a configuration of an antenna in which a conductor is disposed near a cut-off portion in a housing 931 of an electronic device according to various embodiments of the present disclosure and an equivalent circuit diagram thereof.

Referring to FIG. 10A, first and second conductive members 931*a* and 931*b*, cut-off portions 932 and 933, a feeding part 935, a ground part 934, and conductors 938 and 939 are illustrated. The conductors 938 and 939 may be, for example, metallic members. The conductors 938 and 939 may lower the resonant frequency by increasing capacitance and may be used to obtain a resonant frequency in a low-frequency band. The conductors 938 and 939 may have a shape similar to that of a part of the housing 931. For example, when the housing has a circular shape, the conductors 938 and 939 may have a curved shape that has the same radius of curvature as that of the housing 931.

According to an embodiment of the present disclosure, the conductors 938 and 939 and the cut-off portions 932 and 933 may be integrally formed with each other by non-conductive members that are coupled to the housing 931. The housing 931 and the conductors 938 and 939 may be coupled with the non-conductive members through double injection molding. Without being limited thereto, however, the conductors 938 and 939 may be separately disposed within the electronic device.

According to an embodiment of the present disclosure, considering the aesthetic impression of the electronic device, the cut-off portions 932 and 933 may be formed in the coupling members 931*c* and 931*d* in order to minimize the exposure of the cut-off portions externally.

According to an embodiment of the present disclosure, the first conductive member 931*a*, the conductors 938 and 939, the cut-off portions 932 and 933, and the ground part 934 may form a low resonant frequency band including an electrical length A. The first conductive member 931*a*, the feeding part 935, and the ground part 934 may form a high resonant frequency band including an electrical length B.

Referring to the equivalent circuit of FIG. 10B, according to various embodiments of the present disclosure, a feeding part 941, a ground part 942, a low resonant frequency band antenna area 943, and a high resonant frequency band antenna area 944 are illustrated.

According to an embodiment of the present disclosure, the low-frequency antenna 943 illustrated in FIG. 10A may include the first conductive member 931*a*, the conductors 938 and 939, the cut-off portions 932 and 933, and the ground part 934.

The high-frequency antenna 944 may include the first conductive member 931*a*, the feeding part 935, and the ground part 934.

Figure 11A:
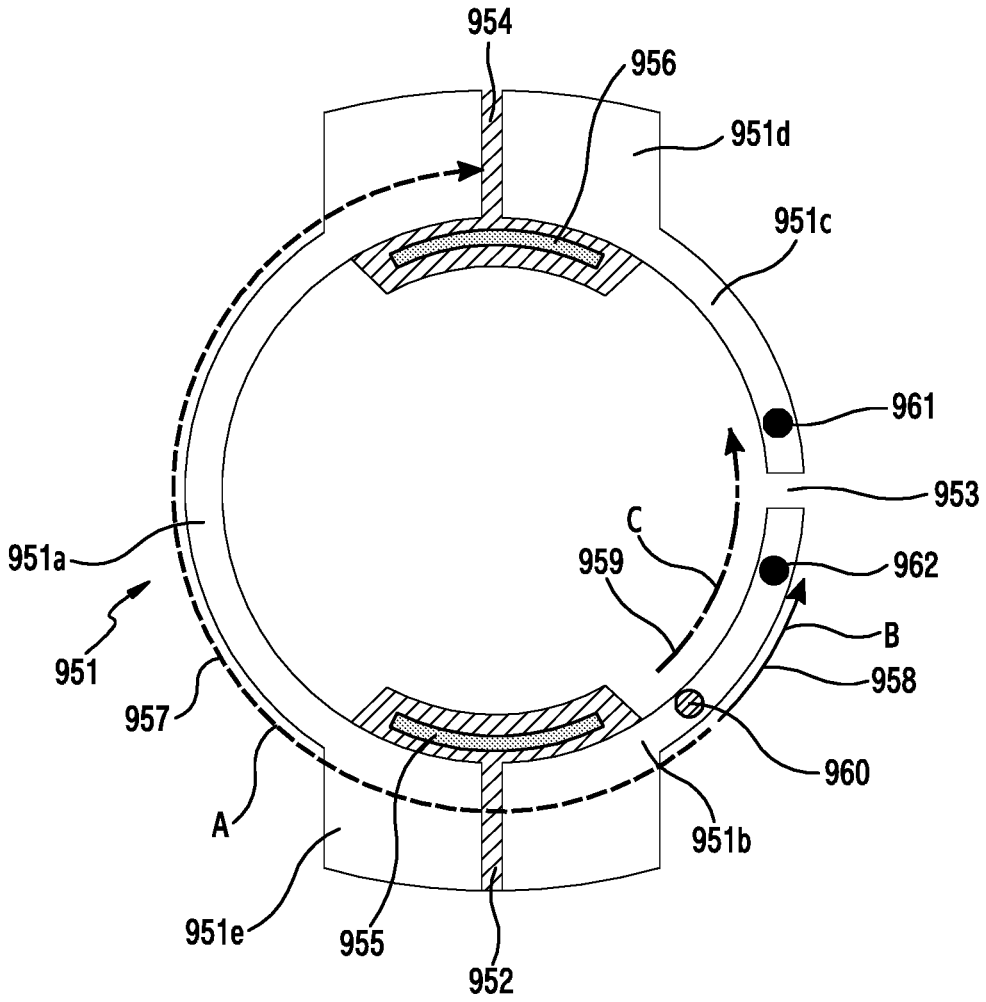
FIGS. 11A and 11B are a view illustrating a configuration of an antenna in which a conductor is disposed near a cut-off portion in the housing of an electronic device according to various embodiments of the present disclosure and an equivalent circuit diagram thereof.
Figure 11B:
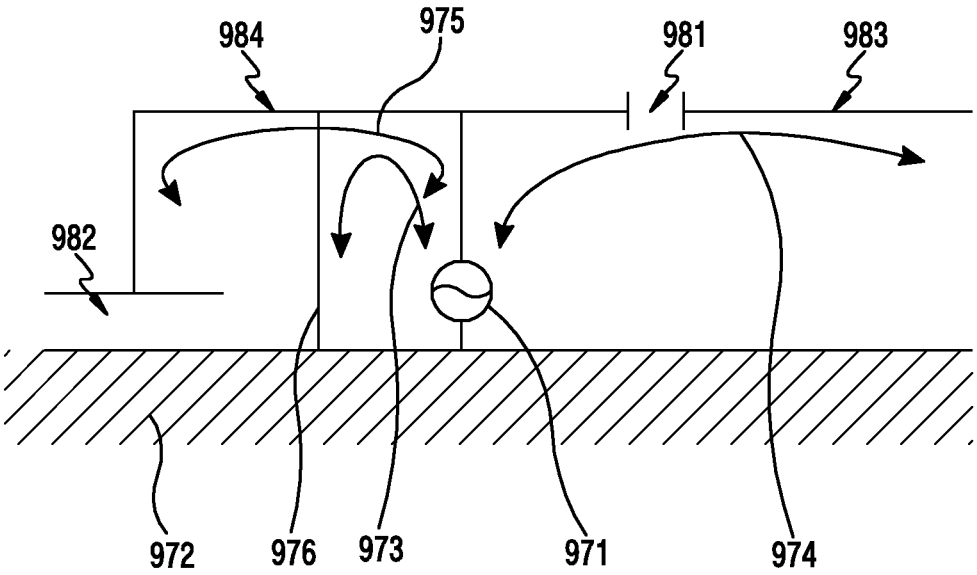

FIGS. 11A and 11B are a view illustrating a configuration of an antenna in which a conductor is disposed near a cut-off portion in the housing of an electronic device according to various embodiments of the present disclosure and an equivalent circuit diagram thereof.

Referring to FIG. 11A, first to third conductive members 951 (951*a*, 951*b*, and 951*c*), coupling members 951*d* and 951*e*, cut-off portions 952 and 954, a feeding part 960, ground parts 961 and 962, and conductors 955 and 956 are illustrated.

According to an embodiment of the present disclosure, the conductors 955 and 956 may be, for example, metallic members. The conductors 955 and 956 may lower a resonant frequency by increasing a capacitance and may be used to adjust a resonant frequency in a low-frequency band. The conductors 955 and 956 may have a shape similar to that of a part of the housing. For example, when the housing has a circular shape, the conductors 955 and 956 may have a curved shape that has the same radius of curvature as that of the housing.

According to an embodiment of the present disclosure, the conductors 955 and 956 and the cut-off portions 952 and 954 may be integrally formed with each other by non-conductive members that are coupled to the housing 951. The housing 951 and the conductors 955 and 956 may be coupled with the non-conductive members through double injection molding. Without being limited thereto, however, the conductors 955 and 956 may be separately disposed within the electronic device.

According to an embodiment of the present disclosure, considering the aesthetic impression of the electronic device, the cut-off portions 952 and 953 may be formed in the coupling members 951*d* and 951*e* in order to minimize the exposure of the cut-off portions externally. Alternatively, a cut-off portion 953 may be formed in the shape of a crown.

According to an embodiment of the present disclosure, the second conductive member 951*b*, the feeding part 960, the conductor 955, the cut-off portion 952, the first conductive member 951*a*, the conductor 956, the cut-off portion 954, and the ground part 961 may form an antenna area A in a first frequency band (e.g. a low resonant frequency band). The feeding part 960, the second conductive member 951*b* and the ground parts 962 may form an antenna area B in a second frequency band (e.g. a first high resonant frequency band). The feeding part 960, the second conductive member 951*b*, the ground parts 961 and 962, and the cut-off portion 953 may form an antenna area C in a third frequency band (e.g. a second high resonant frequency band).

Referring to the equivalent circuit of FIG. 11B, a feeding part 971, a ground part 972, cut-off capacitors 981 and 982, and resonant frequency band antenna areas 983 and 984 are illustrated. The feeding part 971 may correspond to the feeding part 960 of FIG. 11A. The ground part 972 may correspond to the ground part 962 of FIG. 11A. The cut-off capacitor 981 may correspond to the cut-off portions 952 and 954 and the conductors 955 and 956 of FIG. 11A. The ground part 961 and the cut-off portion 953 may correspond to the capacitor 982 and the ground surface 970. The cut-off capacitor 982 may correspond to the cut-off portion 953 of FIG. 11A.

According to an embodiment of the present disclosure, through the feeding part 971, the cut-off capacitor 981, and the ground part 976, a low resonant frequency may be formed and a radiation current 974 may flow, and the radiation current 974 may correspond to the radiation current flow 957 of FIG. 11A. If the antenna operates as an IFA, the antenna may operate through the ground part 976, the feeding part 971, and the capacitor 981 and the electrical path 983. If the antenna operates as a loop antenna, the antenna may operate through the feeding part 971 and the capacitor 981 and the electrical paths 983 and 976. Alternatively, the radiation current 973 that flows through the feeding part 971, the radiator 984, and the ground part 976 may form impedance matching and a high resonant frequency and may correspond to the radiation current 958 of FIG. 11A.

According to an embodiment of the present disclosure, through the area that includes the feeding part 971, the cut-off capacitor 982, and the ground part 972, a high resonant frequency may be formed and the radiation current 975 may flow, and the radiation current 975 may correspond to the radiation current 959 of FIG. 11A.

FIGS. 12A to 12E illustrate various antenna configurations in accordance with a number of antenna cut-off portions according to various embodiments of the present disclosure.

According to an embodiment of the present disclosure, an electronic device may have a cut-off portion that is formed by cutting away a portion of a housing thereof and inserting a non-conductive member into the cutaway portion. The cut-off portion formed in the housing may operate as a capacitor, and when the housing is used as an antenna, an effect the same as, or similar to, increasing the electrical length of the antenna may be obtained by the addition of the cut-off portion. Furthermore, a plurality of antennas may be configured so that various configurations may be possible. For example, in a case where the electronic device is a wearable device, the electronic device has a limitation in size so that the length of an antenna may be restricted, and a cut-off portion may be added to obtain a desired resonant frequency. A capacitance value may vary according to the gap of the cut-off portion.

According to an embodiment of the present disclosure, a cut-off portion may be formed in a connecting portion of a housing to which a coupling member is coupled, a crown mounting hole, and/or a button part in order to minimize the exposure of the cut-off portion to the outside.

Figure 12A:
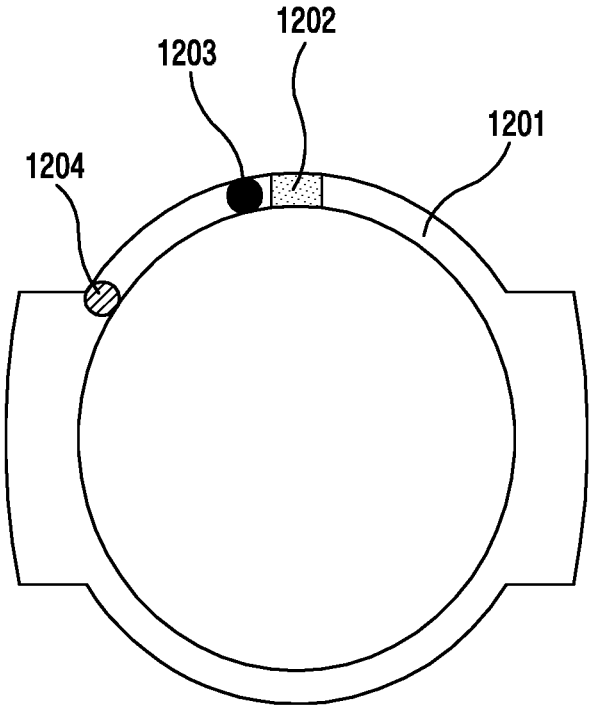
FIGS. 12A to 12E illustrate various antenna configurations in accordance with a number of antenna cut-off portions according to various embodiments of the present disclosure.

Referring to FIG. 12A, a housing 1201 may include a side surface that surrounds at least a part of a display. According to an embodiment, a cut-off portion 1202, a feeding part 1204, and a ground part 1203 may be included in the housing 1201. The housing 1201 may operate as an antenna, and the cut-off portion 1202 may operate as a capacitor. A capacitance may be generated and a resonant frequency may be determined by the cut-off portion 1202. In this case, without being limited to the housing 1201, an external non-metallic housing may have a shape that includes an antenna pattern to be segmented, similar to those illustrated in FIGS. 12A to 12D.

Figure 12B:
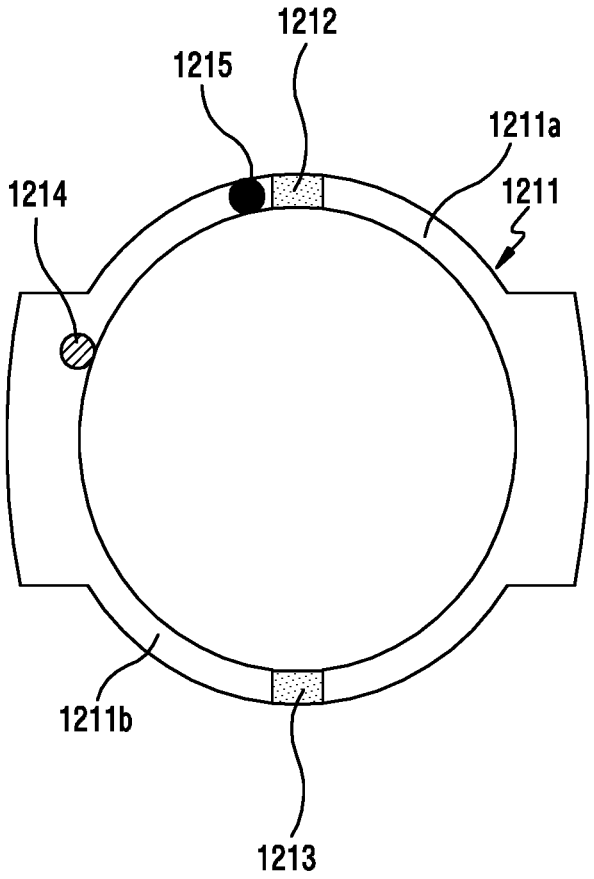

Referring to FIG. 12B, a housing 1211 may include a side surface that surrounds at least a part of a display. The housing 1211 may include cut-off portions 1212, a feeding part 1214, and a ground part 1215. The housing 1211 may operate as an antenna, and the cut-off portions 1212 and 1213 may operate as capacitors. Capacitance may be generated and a resonant frequency may be determined by the cut-off portions 1212 and 1213. Due to the addition of the cut-off portion, the resonant frequency may be lower than that of the antenna illustrated in FIG. 12A.

According to an embodiment of the present disclosure, the housing 1211 may be divided into a first conductive member 1211*a* and a second conductive member 1211*b* by the cut-off portions 1212 and 1213. The cut-off portions 1212 and 1213 may be first and second non-conductive members 1212 and 1213, respectively.

According to an embodiment of the present disclosure, the first conductive member 1211*a* may form a first portion of the side surface, may extend along the side surface, and may include a first end portion and a second end portion. The first non-conductive member 1212 may form a second portion of the side surface and may make contact with the first end portion and/or the second end portion of the first conductive member 1211*a*. Alternatively, the first non-conductive member 1212 may make contact with the first end portion of the first conductive member 1211*a*.

According to an embodiment of the present disclosure, the second conductive member 1211*b* may form a third portion of the side surface, may extend along the side surface, and may include a first end portion and a second end portion. The second conductive member 1211*b* may contact the first non-conductive member 1212 at the first end portion thereof, and may be insulated from the first conductive member 1211*a*.

According to an embodiment of the present disclosure, the first point 1214 of the first conductive member 1211*a* may be electrically connected to a communication circuit. The second point 1215 spaced apart from the first point 1214 of the first conductive member 1211*a* may be electrically connected with a ground member. The communication circuit may be configured to transmit and/or receive a signal in an RF frequency band through at least the first conductive member 1211*a*.

According to an embodiment of the present disclosure, the second non-conductive member 1213 may form a fourth portion of the side surface and may make contact with the second end portion of the first conductive member 1211*a* and the second end portion of the second conductive member 1211*b*.

Figure 12C:
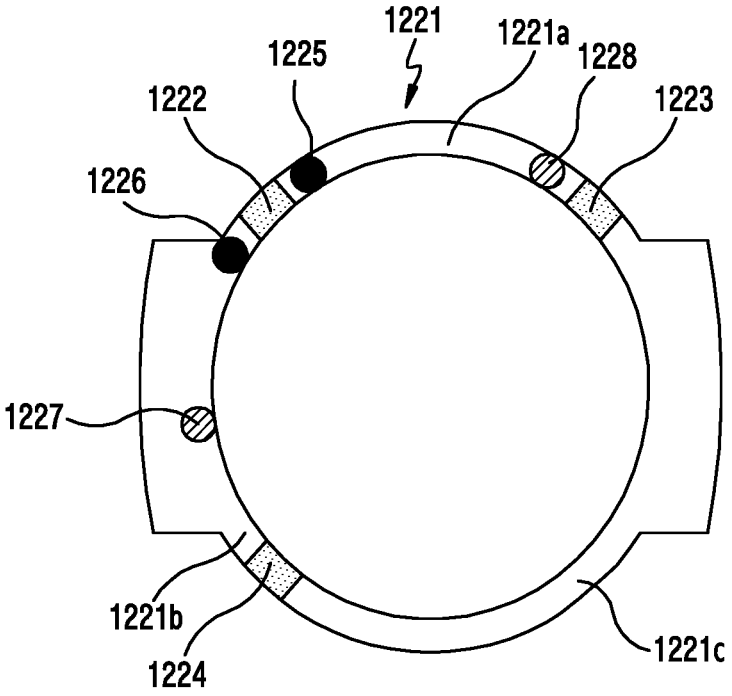

Referring to FIG. 12C, a housing 1221 may include a side surface that surrounds at least a part of a display. According to an embodiment, the housing 1221 may include a first antenna 1221*a*, a cut-off portion 1222, a second antenna 1221*b*, a cut-off portion 1224, a third antenna 1221*c*, and a cut-off portion 1223. The housing 1221 formed of a metallic material may have non-conductive materials coupled thereto to include at least the cut-off portions 1222, 1223, and 1224. The cut-off portions 1222, 1223, and 1224, feeding parts 1227 and 1228, and ground parts 1225 and 1226 may be included in the housing 1221. The housing 1221 may operate as an antenna, and the cut-off portions 1222, 1223, and 1224 may operate as capacitors.

According to an embodiment of the present disclosure, the housing 1221 may form a loop antenna structure that uses the first antenna 1221*a* as the main radiator by virtue of the cut-off portions 1222, 1223, and 1224 and includes the feeding part 1228 and the ground part 1225. The housing may operate as an IFA antenna by additionally including the third antenna 1221*c* and the cut-off portion 1223. The second antenna 1221*b* may operate as an IFA antenna that uses the second antenna 1221*b* as the main radiator and includes the ground part 1226 and the feeding part 1227, and may operate as an IFA antenna that further includes the cut-off portion 1224 and the third antenna 1221*c*. The cut-off portions 1222, 1223, and 1224 may be first to third non-conductive members 1222, 1223, and 1224, respectively.

According to an embodiment of the present disclosure, the first conductive member 1221*a* may form a first portion of the side surface, may extend along the side surface, and may include a first end portion and a second end portion. The first non-conductive member 1222 may form a second portion of the side surface and may make contact with the first end portion and/or the second end portion of the first conductive member 1221*a*. Alternatively, the first non-conductive member 1222 may make contact with the first end portion of the first conductive member 1221*a*.

According to an embodiment of the present disclosure, the second conductive member 1221*b* may form a third portion of the side surface, may extend along the side surface, and may include a first end portion and a second end portion. The second conductive member 1221*b* may contact the first non-conductive member 1222 at the first end portion thereof, and may be insulated from the first conductive member 1221*a*.

According to an embodiment of the present disclosure, the first point 1228 of the first conductive member 1221*a* may be electrically connected to a communication circuit. The second point 1225 spaced apart from the first point 1228 of the first conductive member 1221*a* may be electrically connected with a ground member. The communication circuit may be configured to transmit and/or receive a signal in an RF frequency band through at least the first conductive member 1221*a*.

According to an embodiment of the present disclosure, the second non-conductive member 1223 may form a fourth portion of the side surface and may make contact with the second end portion of the first conductive member 1221*a* and the first end portion of the third conductive member 1221*c*. The first point 1227 of the second conductive member 1221*b* may be electrically connected with at least one communication circuit. The second point 1226 of the second conductive member 1231*b*, which is spaced apart from the first point 1227 of the second conductive member 1221*b*, may be electrically connected with at least one ground member.

According to an embodiment of the present disclosure, the third conductive member 1221*c* may form a fifth portion of the side surface, may extend along the side surface, and may include a first end portion and a second end portion. The third conductive member 1221*c* may contact the second non-conductive member 1223 at the first end portion thereof, and may be insulated from the first and second conductive members 1221*a* and 1221*b*.

According to an embodiment of the present disclosure, the third non-conductive member 1224 may form a sixth portion of the side surface and may make contact with the second end portion of the first conductive member 1221*a* and the second end portion of the third conductive member 1221*c*.

Figure 12D:
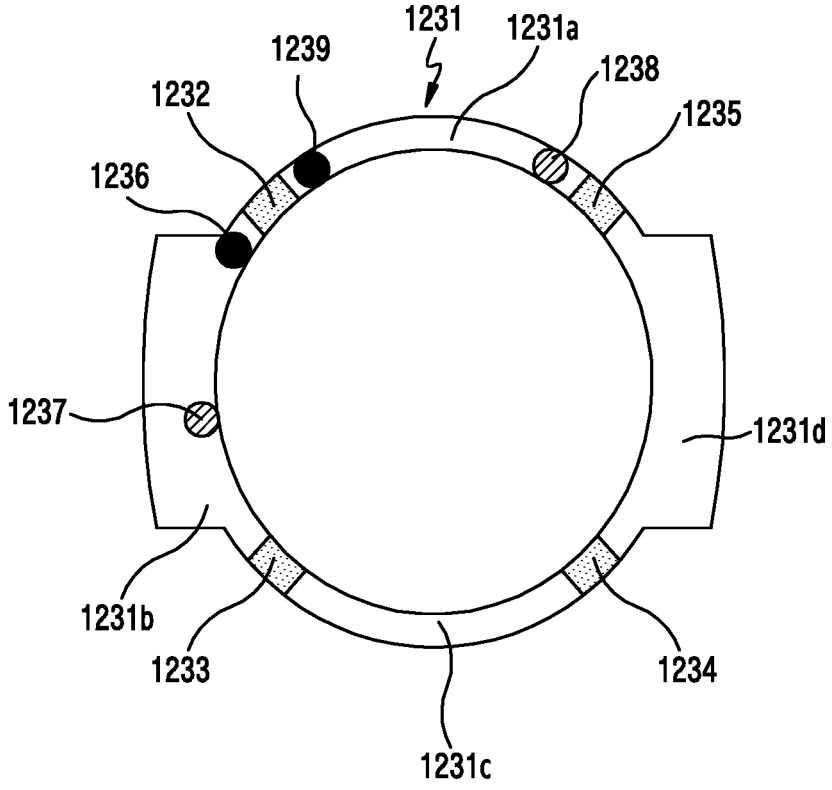

Referring to FIG. 12D, a housing 1231 may include cut-off portions 1232, 1233, 1234, and 1235 and first to fourth conductive members 1231*a*, 1231*b*, 1231*c*, and 1231*d* that are separated from each other by the cut-off portions. According to an embodiment, the cut-off portions 1232, 1233, 1234, and 1235, feeding parts 1237 and 1238, and ground parts 1236 and 1239 may be included in the housing 1231. The housing 1231 may operate as an antenna, and the cut-off portions 1232, 1233, 1234, and 1235 may operate as capacitors. Capacitance may be generated and a resonant frequency may be determined by the cut-off portions 1232, 1233, 1234, and 1235.

According to an embodiment of the present disclosure, the housing 1231 may be divided into the first conductive member 1231*a*, the second conductive member 1231*b*, the third conductive member 1231*c*, and the fourth conductive member 1231*d* by the cut-off portions 1232, 1233, 1234, and 1235. The cut-off portions 1232, 1233, 1234, and 1235 may be first to fourth non-conductive members 1232, 1233, 1234, and 1235, respectively.

According to an embodiment of the present disclosure, the first conductive member 1231*a* may form a first portion of the side surface of the housing 1231, may extend along the side surface, and may include a first end portion and a second end portion. The first non-conductive member 1232 may form a second portion of the side surface and may make contact with the first end portion and/or the second end portion of the first conductive member 1231*a*. Alternatively, the first non-conductive member 1232 may make contact with the first end portion of the first conductive member 1231*a*.

According to an embodiment of the present disclosure, the second conductive member 1231*b* may form a third portion of the side surface of the housing 1231, may extend along the side surface, and may include a first end portion and a second end portion. The second conductive member 1231*b* may contact the first non-conductive member 1232 at the first end portion thereof, and may be insulated from the first conductive member 1231*a*.

According to an embodiment of the present disclosure, the first point 1238 of the first conductive member 1231*a* may be electrically connected to a communication circuit. The second point 1236 spaced apart from the first point 1238 of the first conductive member 1231*a* may be electrically connected with a ground member. The communication circuit may be configured to transmit and/or receive a signal in an RF frequency band through at least the first conductive member 1231*a*.

According to an embodiment of the present disclosure, the second non-conductive member 1233 may form a fourth portion of the side surface and may make contact with the second end portion of the second conductive member 1231*b* and the first end portion of the third conductive member 1231*c*. The first point 1237 of the second conductive member 1231*b* may be electrically connected with at least one communication circuit. The second point 1236 of the second conductive member 1231*b*, which is spaced apart from the first point 1237 of the second conductive member 1231*b*, may be electrically connected with at least one ground member.

According to an embodiment of the present disclosure, the third conductive member 1231*c* may form a fifth portion of the side surface of the housing 1231, may extend along the side surface, and may include a first end portion and a second end portion. The third conductive member 1231*c* may contact the second non-conductive member 1233 at the first end portion thereof, and may be insulated from the second and fourth conductive members 1231*b* and 1231*d*.

According to an embodiment of the present disclosure, the third non-conductive member 1234 may form a sixth portion of the side surface of the housing 1231 and may make contact with the second end portion of the third conductive member 1231*c* and the first end portion of the fourth conductive member 1231*d*.

According to an embodiment of the present disclosure, the fourth conductive member 1231*d* may form a seventh portion of the side surface of the housing 1231, may extend along the side surface, and may include a first end portion and a second end portion. The fourth conductive member 1231*d* may contact the third non-conductive member 1234 at the first end portion thereof, and may be insulated from the first and third conductive members 1231*a* and 1231*c*.

According to an embodiment of the present disclosure, the fourth non-conductive member 1235 may form an eighth portion of the side surface of the housing 1231 and may make contact with the second end portion of the first conductive member 1231*a* and the second end portion of the fourth conductive member 1231*d*.

Figure 12E:
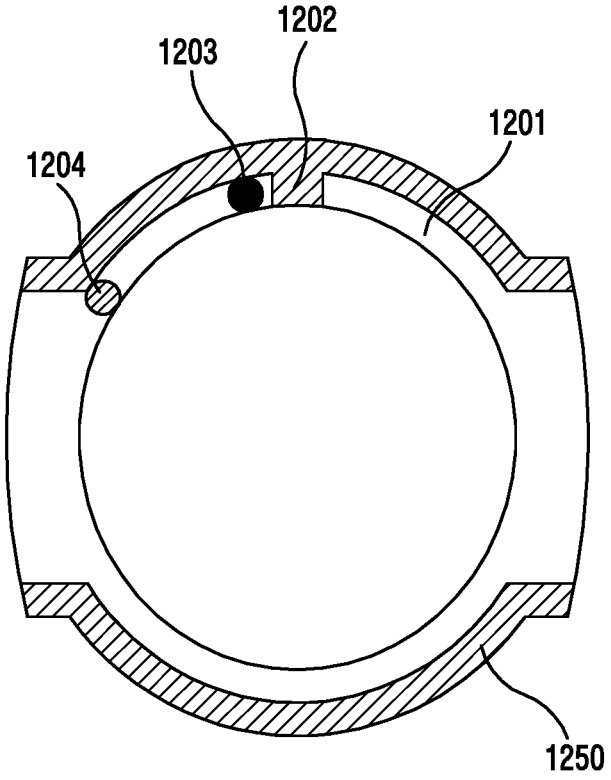

Referring to FIG. 12E, a housing 1201 may include a side surface that surrounds at least a part of a display. According to an embodiment, a cut-off portion 1202, a feeding part 1204, and a ground part 1203 may be included in the housing

1201. The housing 1201 may operate as an antenna, and the cut-off portion 1202 may operate as a capacitor.

According to an embodiment of the present disclosure, the housing 1201 may be coupled by a non-conductive material 1250 that includes the cut-off portion 1202. The non-conductive material 1250 may be coupled with the housing 1201 through double injection molding, insert molding, or structural coupling.

Figure 13A:
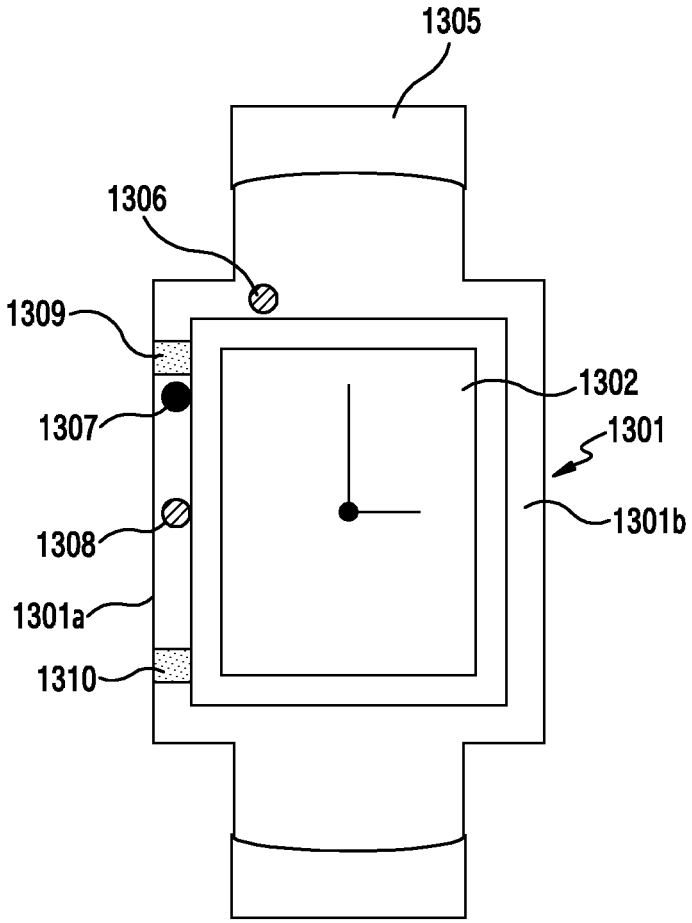
FIGS. 13A to 13C illustrate various antenna configurations in an electronic device that has a rectangular display and a rectangular housing according to various embodiments of the present disclosure.
Figure 13B:
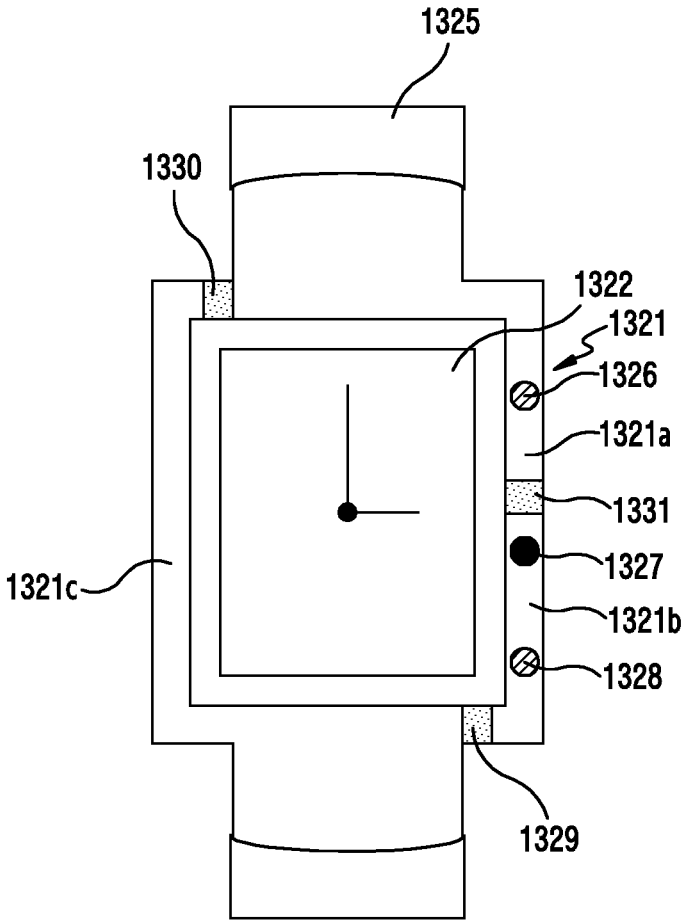
Figure 13C:
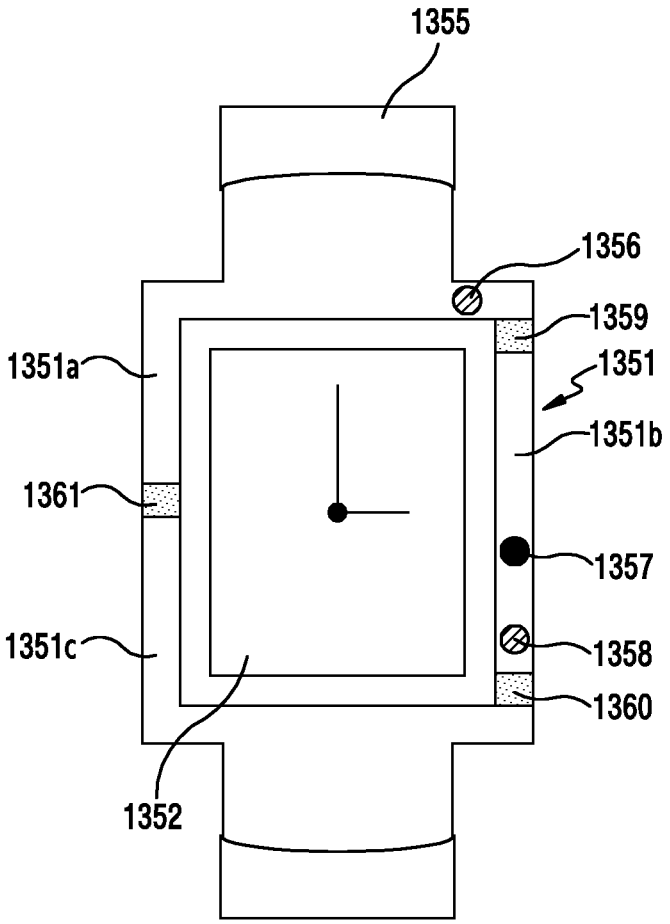

FIGS. 13A to 13C illustrate various antenna configurations in an electronic device that has a rectangular display and a rectangular housing an various embodiments of the present disclosure.

Referring to FIG. 13A, the electronic device may include a housing 1301, a plurality of cut-off portions 1309 and 1310, feeding parts 1306 and 1308, a ground part 1307, a display 1302, and a coupling member 1305.

According to an embodiment of the present disclosure, the housing 1301 may include first and second conductive members 1301*a* and 1301*b* that are separated from each other by the plurality of cut-off portions 1309 and 1310.

According to an embodiment of the present disclosure, the first conductive member 1301*a* may be electrically connected to an RF module of a board by the feeding part 1308, and may be grounded to the board by the ground part 1307 that is spaced apart from the feeding part 1308. The second conductive member 1301*b* may be electrically connected to the RF module of the board by the feeding part 1306.

According to an embodiment of the present disclosure, the housing 1301 may operate as a multi-band antenna that operates in a variety of bands.

According to an embodiment of the present disclosure, the first conductive member 1301*a* may operate as a first antenna through the feeding part 1308 and the ground part 1307. The second conductive member 1301*b* may operate as a second antenna through the feeding part 1306.

According to an embodiment of the present disclosure, graphic objects may be displayed on the display 1302. The coupling member 1305, which is configured to be attached to, and detached from, a part of a user's body, may be connected to one side and/or an opposite side of the housing 1301, which corresponds to the one side.

Referring to FIG. 13B, the electronic device may include a housing 1321, a plurality of cut-off portions 1329, 1330, and 1331, feeding parts 1326 and 1328, a ground part 1327, a display 1322, and a coupling member 1325.

According to an embodiment of the present disclosure, the housing 1321 may include first to third conductive members 1321*a*, 1321*b*, and 1321*c* that are separated from each other by the plurality of cut-off portions 1329, 1330, and 1331.

According to an embodiment of the present disclosure, the first conductive member 1321*a* may be electrically connected to an RF module of a board by the feeding part 1326. The second conductive member 1321*b* may be electrically connected to the RF module of the board by the feeding part 1328, and may be grounded to the board by the ground part 1327 that is spaced apart from the feeding part 1328.

According to an embodiment of the present disclosure, the housing 1321 may operate as a multi-band antenna that operates in a variety of bands.

According to an embodiment of the present disclosure, the first conductive member 1321*a*, the feeding part 1326, the cut-off portion 1330, and the third conductive member 1321*c* may serve as a first antenna that operates at the first resonant frequency. The second conductive member 1321*b* may serve as a second antenna that operates in the second resonant frequency through the feeding part 1328 and the ground part 1327.

According to an embodiment of the present disclosure, graphic objects may be displayed on the display 1322. The coupling members 1325, which is configured to be attached to, and detached from, a part of a user's body, may be connected to one side of the housing 1321.

Referring to FIG. 13C, the electronic device may include a housing 1351, a plurality of cut-off portions 1359, 1360, and 1361, feeding parts 1356 and 1358, a ground part 1357, a display 1352, and a coupling member 1355.

According to an embodiment of the present disclosure, the housing 1351 may include first to third conductive members 1351*a*, 1351*b*, and 1351*c* that are separated from each other by the plurality of cut-off portions 1359, 1360, and 1361.

According to an embodiment of the present disclosure, the first conductive member 1351*a* may be electrically connected to an RF module of a board by the feeding part 1356. The second conductive member 1351*b* may be electrically connected to the RF module of the board by the feeding part 1358, and may be grounded to the board by the ground part 1357 that is spaced apart from the feeding part 1358.

According to an embodiment of the present disclosure, the housing 1351 may operate as a multi-band antenna that operates in a variety of bands.

According to an embodiment of the present disclosure, the first conductive members 1351*a*, the feeding part 1356, the cut-off portion 1361, and the third conductive member 1351*c* may serve as a first antenna that operates at the first resonant frequency. The second conductive member 1351*b* may serve as a second antenna that operates in the second resonant frequency through the feeding part 1358 and the ground part 1357.

According to an embodiment of the present disclosure, graphic objects may be displayed on the display 1352. The coupling members 1355, which is configured to be attached to, and detached from, a part of a user's body, may be connected to one side of the housing 1351.

The electronic device, according to an embodiment of the present disclosure of the present disclosure, may implement a multi-band antenna by segmenting the housing (e.g., metal bezel, metal cover, etc.) of the wearable electronic device, which contain a conductive material, into multiple parts.

The electronic device, according to an embodiment of the present disclosure, may implement an antenna having various resonant characteristics by adjusting the locations and number of cut-off portions in the housing thereof.

The electronic device, according to an embodiment of the present disclosure, may compensate for the resonant length using a capacitance generated by a gap of a cut-off portion.

Although the electronic devices according to the various embodiments have been described through the limited illustrative embodiments and the drawings, the electronic devices according to the various embodiments of the present disclosure are not intended to be limited to the illustrative embodiments, and various modifications and changes may be made by those skilled in the art to which the electronic devices according to the various embodiments belong.

Various embodiments disclosed herein are provided merely to easily describe technical details of the present disclosure and facilitate understanding of the present disclosure, but are not intended to limit the scope of the present disclosure. Therefore, it is intended that the present disclosure be construed that all modifications and changes or modified and changed forms based on the present disclosure fall within the scope of the present disclosure, as defined by the appended claims and their equivalents.

What is claimed is:

1. An electronic device, comprising:

a display;

a housing comprising a side surface that surrounds at least a part of the display;

a plurality of conductive members disposed along the side surface;

a plurality of non-conductive members disposed between respective conductive members of the plurality of conductive members;

at least one communication circuit electrically connected to a first point of a first conductive member among the plurality of conductive members;

a metal member disposed inside the housing such that the metal member is apart from the plurality of conductive members and the plurality of non-conductive members;

a first ground member disposed inside the housing and electrically connected to a second conductive member of the plurality of conductive members;

a second ground member disposed inside the housing and electrically connected to a third conductive member of the plurality of conductive members; and a feeding part contacting the second conductive member, wherein the plurality of non-conductive members comprise a first non-conductive member between the second conductive member and a first conductive member of the plurality of conductive members, a second non-conductive member between the first conducting member and the third conductive member, and a third non-conductive member between the third conductive member and the second conductive member, wherein the first non-conductive member, the first conductive member, and the second non-conductive member form a capacitor, wherein at least one of the plurality of the conductive members, the plurality of the non-conductive members, and the metal member is configured to operate as an antenna radiator, wherein, to operate as an inverted-F antenna, the antenna radiator only operates through the feeding part, the second ground member, and the capacitor, and wherein, to operate as a loop antenna, the antenna radiator operates through the feeding part, the second ground member, the capacitor, and the second ground.

2. The electronic device of claim 1, wherein a third point of the second conductive member among the plurality of conductive members is electrically connected with the at least one communication circuit.

3. The electronic device of claim 2, wherein a fourth point of the second conductive member is spaced apart from the third point.

4. The electronic device of claim 3, wherein the first non-conductive member is formed in a part of the housing to which the coupling member is connected.

5. The electronic device of claim 3, wherein the electronic device further comprises a manipulation unit, wherein the manipulation unit is mounted on at least one of the first non-conductive member, the second non-conductive member, and the third non-conductive member.

6. The electronic device of claim 1, wherein the at least one communication circuit is configured to transmit or receive a signal in a radio frequency (RF) band through at least the first conductive member.

7. The electronic device of claim 6, wherein the housing is a radiator of a multi-band antenna.

8. The electronic device of claim 7, wherein the electronic device is configured to change at least one of a length of the first conductive member, a material of the first non-conductive member, and a thickness of the first non-conductive member to regulate a resonant frequency of the multi-band antenna.

9. The electronic device of claim 1, wherein the housing comprises a first surface oriented in a first direction and a second surface oriented in a second direction that is opposite to the first direction, and wherein the side surface surrounds a space between the first surface and the second surface; and a through-hole through which the display is exposed is formed in the first surface.

10. The electronic device of claim 9, wherein the display is configured in a circular shape as viewed from the first surface of the housing.

11. The electronic device of claim 1, wherein the electronic device further comprises a main board, wherein the main board is disposed between the second surface and the display within the housing.

12. The electronic device of claim 11, wherein the at least one communication circuit is disposed on the main board.

13. The electronic device of claim 11, wherein the first point and the second point of the first conductive member are connected with the main board through a resilient connecting member.

14. The electronic device of claim 1, wherein the metal member is configured to increase a capacitance.

15. The electronic device of claim 1, wherein the metal member is disposed along an inner surface of the housing.

16. The electronic device of claim 15, wherein the metal member is disposed on an area corresponding the first non-conductive member or the second non-conductive member.

17. The electronic device of claim 15, wherein the metal member has a shape corresponding a part of the housing which is adjacent to the metal member.

18. The electronic device of claim 1, wherein the electronic device includes a wearable device.

* * * * *